US005615179A

United States Patent [19]

Yamamoto et al.

[11] Patent Number: 5,615,179

[45] Date of Patent: Mar. 25, 1997

[54] ELECTRONIC APPARATUS WITH FITTING BAND

[75] Inventors: Akio Yamamoto; Wataru Iwanami; Hiroshi Yabe; Kenji Yamazaki; Tatsumi Miyashita; Akeshi Tsurubuchi, all of Suwa, Japan

[73] Assignee: Seiko Epson Corporation, Tokyo, Japan

[21] Appl. No.: 392,877

[22] PCT Filed: Jul. 4, 1994

[86] PCT No.: PCT/JP94/01087

§ 371 Date: May 1, 1995

§ 102(e) Date: May 1, 1995

[87] PCT Pub. No.: WO95/02210

PCT Pub. Date: Jan. 19, 1995

[30] Foreign Application Priority Data

May 7, 1993 [JP] Japan ..... 5-165745
Sep. 8, 1993 [JP] Japan ..... 5-197511

[51] Int. Cl.[6] ..... A44C 5/00; G04B 37/00

[52] U.S. Cl. ..... 368/281; 224/168

[58] Field of Search ..... 228/167, 168, 228/170, 171, 174, 175, 179; 368/281, 2

[56] References Cited

U.S. PATENT DOCUMENTS

| | | | |
|---|---|---|---|
| 839,538 | 12/1906 | Becker | 224/168 |
| 2,542,284 | 2/1951 | Mayson | 224/175 |
| 2,695,740 | 11/1954 | Kolbe | 224/175 |
| 3,580,438 | 5/1971 | Raval | 224/168 |
| 3,729,923 | 5/1973 | Brigliano et al. | 224/175 |
| 4,194,355 | 3/1980 | Nishida | 368/281 |
| 4,769,656 | 9/1988 | Dickey | 224/175 |
| 5,144,599 | 9/1992 | Blaich et al. | 368/281 |

FOREIGN PATENT DOCUMENTS

| | | | |
|---|---|---|---|
| 0186804 | 7/1986 | European Pat. Off. | 368/281 |
| 51-161161 | 12/1976 | Japan . | |
| 56-114493 | 9/1981 | Japan . | |
| 57-86492 | 11/1981 | Japan . | |
| 56-151381 | 11/1981 | Japan . | |
| 62-184494 | 11/1987 | Japan . | |
| 2-257722 | 10/1990 | Japan . | |

*Primary Examiner*—Bernard Roskoski
*Attorney, Agent, or Firm*—Stroock & Stroock & Lavan

[57] ABSTRACT

An electronic apparatus with a fitting band has a structure for containing conductive members in the fitting band which permits easy production of the fitting band and which improves the durability, design, fitting properties and so on of the fitting band containing the conductive members.

An end piece plate (21*a*) which forms an end piece (21) has recessed portions (21*c*) formed for holding pipes (50) and conductive wires (30) under predetermined pressure. A piece plate (31*a*) which forms a piece member (31) has recessed portions (31*c*) formed for containing, with play, the pipes (50) and the conductive wires (30). The conductive wires (30) which are passed through the pipes (50) are mounted on the end piece plate (21*a*) and the piece plate (31*a*) so as to rotatably connect the end piece (21) and the piece member (31) after assembly. Since the end piece (21) is fixed to the case band of a wrist watch, no load is applied to the connection portion at the ends (30*a*) of the conductive wires (30).

11 Claims, 22 Drawing Sheets

FIG. 32A
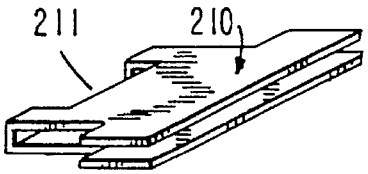
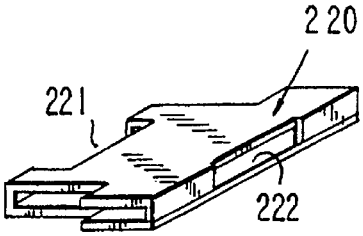
FIG. 32B
FIG. 32C
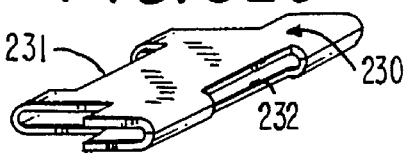
FIG. 32D
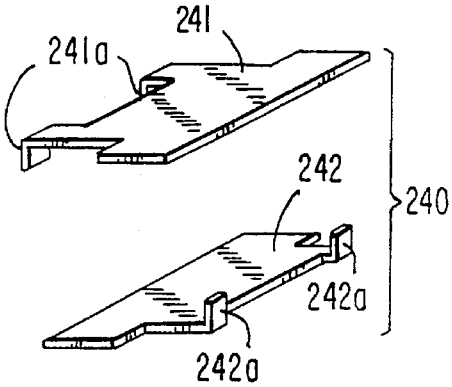
FIG. 32E
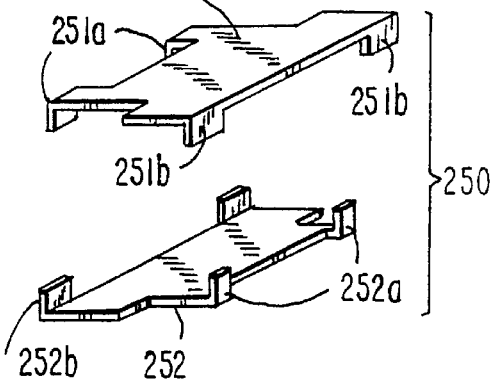
FIG. 32F
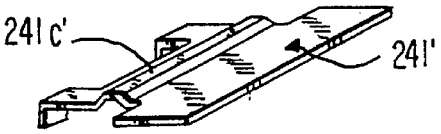
FIG. 32G
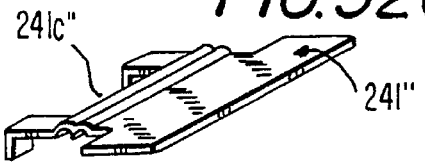

FIG. 37
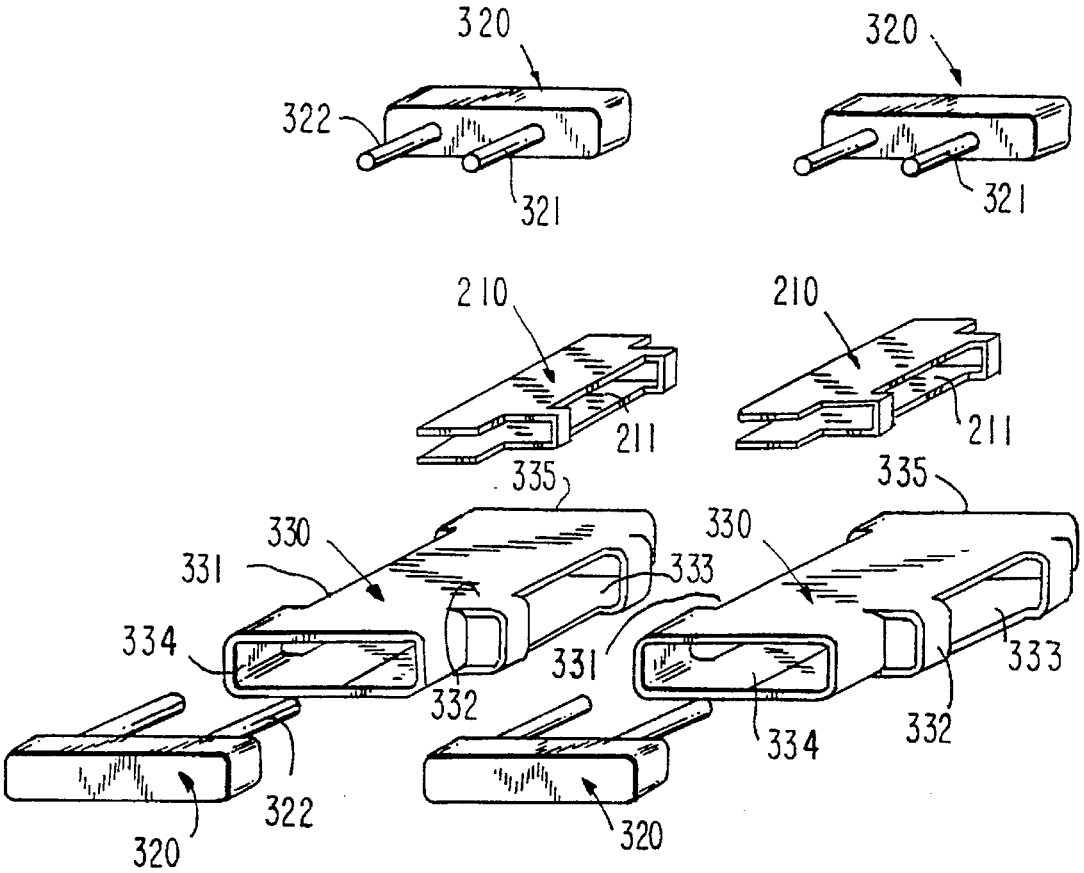
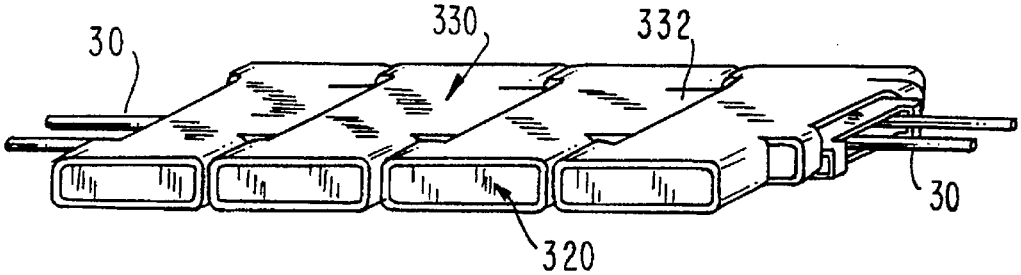
FIG. 38

ELECTRONIC APPARATUS WITH FITTING BAND

TECHNICAL FIELD

The present invention relates to an electronic apparatus having a fitting band, and particularly to the construction of an electronic wrist watch containing a battery, a wrist watch having the function to measure pulse, body temperature or the communicating function, or other electronic apparatus having a conductive member disposed in a fitting band.

BACKGROUND ART

Materials and structures of bands which are conventionally used in wrist watch-type electronic apparatus and which contain conductive members therein, structures for mounting a band on the case of a wrist watch type electronic apparatus, and structures of band mounting portions of the case of a wrist watch type electronic apparatus are proposed in Japanese Laid-Open Utility Model Nos. 56-114492, 56-114493, 58-65908, 58-77492 and 62-71589, Japanese Laid-Open Patent Nos. 63-197103 and 1-279603, and Japanese Laid-Open Utility Model Nos. 3-30890, 3-30891 and 3-30892.

All materials of the bands disclosed in the above publications are non-metallic materials such as natural leather, artificial leather, insulating high-molecular resins, and elastomer fibers.

The band structures disclosed include a structure in which a magnetic powder is contained in leather, and a metallic piece is added to the widthwise side of a band, a structure in which a flexible metallic plate such as a foil or mesh is contained in leather, a structure in which a conductive high-molecular resin is contained in an insulating high-molecular resin, a structure in which a flexible circuit substrate is contained in a resin, a structure in which a flexible sheet is contained in a synthetic resin to provide a switching function, and a structure in which a wire is contained in a fabric having elasticity and comprising elastomer fibers.

Japanese Patent Laid-Open Nos. 63-197103 and 1-279603 also disclose a structure in which a conductor is passed zigzag through continuous links of a metallic expansion band.

The structures for mounting a band on the case of a wrist watch type electronic apparatus include: a structure in which a band is mounted by a spring bar; a structure in which a band is mounted by holding it between a case band and a case back, both of which form a case of a wrist watch type electronic apparatus; a structure in which a band is screwed to a case of a wrist watch type electronic apparatus; and a structure in which a case of a wrist watch-type electronic apparatus and a band are integrated by holding the case of the wrist watch type electronic apparatus from the upper and lower sides thereof.

All band mounting portions of the cases of wrist watch-type electronic apparatus have a known "Roof-attached Horn style" structure on the case of a wrist watch, except a structure in which the band and the case of the wrist watch-type electronic apparatus are integrated by holding a case of the wrist watch-type electronic apparatus from the upper and lower sides thereof.

Some electronic wrist watches have a solar cell, or a generating device provided in the case of the watch so as to convert rotation of an oscillating weight into a coil current.

In a watch having a generating device, the electric power generated by the generating device is stored in a secondary battery (for example, a large-capacity capacitor having an electrical double layer) which is contained in the case of the watch so that the driving motor, IC and a display of the watch are driven by the stored electric power.

On the other hand, in regard to usual electronic wrist watches, Japanese Utility Model Laid-Open Nos. 58-77493 and 3-30892 disclose a structure in which a circuit is contained in a band, and Japanese Utility Model Laid-Open Nos. 59-137588 and 59-137589 disclose a structure in which a piezoelectric element, an electromagnet coil, a rectifying circuit and a battery are contained in a band.

The material and structure of a band containing a conductive member, which are used for conventional wrist watch-type electronic apparatus, the structure for mounting the band on the case of the wrist watch-type electronic apparatus, and the structure of the band mounting portion of the case of the wrist watch-type electronic apparatus have the following problems to be solved with respect to the properties of fitting on an arm, the suitability of the band, strength, durability, limits on design and so on.

First, the band material has the problem that although most conventional bands are made of a non-metallic material from the viewpoint of the need to ensure insulating properties, the band design which is important for creating demand can be selected from only a narrow range in view of the present situation where metallic bands are frequently used for wrist watches for reasons of use environment, durability and design. This is undesirable for merchandise variation.

Second, each of the above structures of the bands has the following problem:

1) The structure in which a metallic plate is attached to the widthwise side of a leather or synthetic resin band has the problem that fitness deteriorates due to an increase in flexural rigidity.

2) Where a metallic plate is contained in a leather or synthetic resin base, although the use of a thin metallic plate causes the same degree of suitability as that of a band comprising only leather or synthetic resin, the metallic plate is cut or cracked by bending or twisting of a band or continuous use for a long period of time, thereby causing the problem of durability.

3) The band structure in which elastic fibers comprising an elastomer resin are used has faults peculiar to such an expansion band. In other words, when it is desired to adjust the length and elasticity of the band in accordance with the thickness of an arm and liking, a plurality of bands having different lengths and degrees of elasticity must be previously prepared. In addition, since the band must invariably be expanded at the time of setting on an arm or separating therefrom, it is necessary to increase the flexibility of the internal structure contained in the band and to ensure durability to deformation.

4) Although a wire is provided zigzag in the expansion band in order to ensure flexibility and durability to deformation, tensile stress more or less acts on the wire at the time of setting on an arm or removing therefrom, while contraction and expansion properties cannot be supplied to the wire itself. If large deformation is repeatedly produced by continuous use of the band, therefore, the zigzag form cannot be maintained, and unevenness occurs in the zigzag form, thereby affecting the fit. In addition, since the wire in the terminal fixing portion of a fabric is fixed, if large stress is applied to the wrist watch-type electronic apparatus by dropping it onto a floor, the wire itself in the terminal fixing portion might be deformed.

In the structure in which a wire is woven in a zigzag manner into a fabric, the displacement amount and displacement process of the fabric, which change in accordance with the tensile force acting at the time of setting or removing the band, are different from those of the wire. When the band length at the time of no load is different from the length at the time of setting (i.e. the band is stretched when set on an arm), distortion occurs in the band, and fit thus deteriorates. For the same reason, there is also the fault that the fabric in which the wire is woven is cut in a portion near the wire.

Where a wire woven in a helical form is passed through a sleeve-like fabric, there is the problem that fit deteriorates due to an increase in flexural rigidity.

5) The structure disclosed in Japanese Laid-Open Patent Nos. 63-197103 and 1-279603 in which a conductor is disposed zigzag in continuous links of a metallic expansion band has not only the same problems as those described above with respect to the expansion band, but also the problem that since the link mechanism of the metallic expansion band is complicated, and the wire must be contained zigzag in the link mechanism, the assembly step is complicated, and the cost is thus increased. Further, the metallic expansion band has a simple plane form and thus has no feeling of high grade, and it is difficult to attempt to diversify the design of the band.

Third, each of the above conventional band mounting structures of the bodies of the wrist watch type-electronic apparatus has the following problems:

1) Where a spring bar is used, since the band rotates around a spring bar relative to the watch case, the required electrical connection between the watch case and the band cannot achieve the predetermined purpose unless the watch case and the band always contact under a predetermined pressure. Since the band is rotatably mounted on the watch case under a predetermined contact pressure, the rotation of the band inevitably becomes awkward. In continuous use for a long period of time, since relative rotation between contact terminals under the contact pressure is repeated, the contact terminals are worn, and the contact pressure decreases with use. In addition, the need for relative rotation between the contact terminals makes it difficult to provide reliable waterproofness.

2) Where the band is mounted by holding it between a case band and a case back, both of which form the watch case, the band must be mounted on the watch case at a predetermined angle with respect to an arm. However, a leather or synthetic resin band cannot sufficiently bend by its own weight because of the presence of a conductive member therein, and a snap closure must be operated while forcing the band to bend along the arm. Thus, the mounting work is difficult, and the watch may be dropped due to the difficulties in the work. In this case, there are problems that the conductive member in the band is cut or cracked due to twisting, expansion and contraction which are produced by bending of the band mounting portion of the watch case. For example, when a silicon resin band is used, the band body itself might be cracked.

3) Where a band is screwed to the watch case, and where the watch case and the band are integrated by holding the watch case from the upper and lower sides thereof, there are faults which are basically the same as those described in paragraph 2 above.

Fourth, the structure of the band mounting portion of the wrist watch type electronic apparatus has the following problems: Although the cases of conventional watches are made of a metal with high rigidity, the bands disclosed in most documents are made of non-metal materials having strength lower than that of the cases. When either the front or the rear of a non-metallic band is fixed to the watch case, the maximum bending moment acts on a portion near the band fixing portion due to bending of the band, and thus the band is easily broken at that position. This causes the need for a "Roof-attached Horn style" structure as the band mounting structure of the watch case in which the band is held between a roof portion and a case back. As a result, the very important plane design of the watch case which visually appeals to consumers is significantly limited, thereby resulting in the fault that the design cannot be varied.

An electronic wrist watch containing a battery has the following problems: Although the electronic wrist watch containing a generating device preferably has a secondary battery having as large a capacity as possible, the capacity is limited because the battery is contained in the watch case. In addition, since only a specified secondary battery can be used for satisfying performance, such as the allowable number of recharges and so on, the storage capacity is not sufficient. For example, an ordinary wrist watch can be driven for only a few days in a state where it is removed from an arm. A limiter circuit is contained for preventing the secondary battery from being overcharged by the electric power generated from the generating device so that excess electric power is discarded. For example, during the period that a person with the watch set on the arm normally uses the watch, about half of the electric power generated from the generating device is discarded.

Although it is recognized that the wrist watch disclosed in each of the above documents is advanced in that a space for containing a battery and so on is formed in the band apart from the watch case, no measure is taken for durability and against accidents such as cutting of a circuit or wiring in the band, the troubles in the generating portion caused by bending of the band, etc., which are actually caused in the band containing a battery.

The present invention has been achieved in consideration of the above problems, and an object of the present invention is to solve the problems of the band itself or the mounting structure in a wrist watch type-electronic apparatus having a band containing conductive members therein, and to realize an internal structure of a band which has high durability and which reduces breaking of wire and trouble.

DISCLOSURE OF THE INVENTION

The present invention provides an electronic apparatus with a case and a fitting band containing conductive members therein, wherein the fitting band comprises an end piece engaging the case and a base connected to the end piece so that it can rotate in the direction of bending of the fitting band at the time of fastening, and the conductive members are contained so as to be held by the end piece with a predetermined strength and to be movable relative to the base for at least a predetermined amount.

The end piece is preferably fixed to the case. Hollow members are preferably provided between the end piece and the base so as to be substantially parallel to the rotation axis thereof, the conductive members being respectively passed through the hollow members. In this case, each of the hollow members preferably comprises a cylindrical connecting shaft provided between the end piece and the base.

The base comprises a plurality of piece members which are connected in the direction of expansion of the fitting band so that they can rotate in the direction of bending at the time of fastening of the band, and the hollow members are preferably provided at least between the piece members in which the conductive members are respectively disposed, so as to be substantially parallel to the rotation axis of the piece members, the conductive members being respectively passed through the hollow members.

The case contains a generating device, a secondary battery for accumulating the electric power generated from the generating device, and an electronic device driven by output of the secondary battery, and, in some cases, an auxiliary secondary battery is provided in the fitting band so as to store excess electric power of the electric power generated by the generating device, which cannot be stored in the secondary battery.

It is preferred to provide a selection means for selectively supplying electric power to the auxiliary secondary battery or taking out electric power therefrom. In this case, a selective switching circuit is preferably provided with control means for adjusting the charging rate of the secondary battery or intermitting the connection of the auxiliary secondary battery so as to prevent overcharging of the secondary battery on the basis of the charging state of the secondary battery, or control means for cutting off the connection of the auxiliary secondary battery when detecting an abnormality of the auxiliary secondary battery. The selection switching circuit is also preferably provided with current limiting means for limiting charging current supplied to the auxiliary secondary battery.

In some cases, each of the conductive members may be passed through an insertion hole provided in the case or the fitting band, or through an insulating surrounding member comprising an insulator and completely surrounding the conductive member.

The insulating surrounding member is preferably secured to the case with a gap between the conductive member and the insulating surrounding member, and provided with flexibility which permits deformation of the insulating surrounding member with rotation of the fitting band. It is also preferred to form a projecting seal portion integrally with each of the insulating surrounding members in order to secure sealing between the conductive member and the insertion hole, and to provide a conductive member's coating portion integrally with the insulating surrounding member, which is extended along the conductive member.

In some cases, the fitting band comprises a housing unit for containing insertion holes for respectively passing the conductive members therethrough and an electronic function member conductively connected through the insertion holes, and a mounting member having through holes corresponding to the insertion holes, and a sealing member for sealing the insertion holes through which the conductive members are respectively passed, the sealing member being held under pressure in narrow portions between the mounting member and the housing unit to hold the conductive members passed through the insertion holes and the through holes.

The fitting band may, in some cases, comprise a plurality of piece members each of which has openings for passing the conductive members and which are rotatably connected to each other in the direction of extension thereof, and a rotation limiting structure is provided on the piece members so as to limit the angle of rotation with respect to adjacent piece members.

Each of the piece members includes an inner piece member for passing the conductive members therethrough, and an outer sheath member for containing the inner piece member so that the inner piece member can rotate for an angle of rotation within a predetermined range. In this case, an opening is preferably provided in each of the outer sheath members so that the inner piece member can partly be exposed and connected to an adjacent outer sheath member. In some cases, the inner piece member comprises at least a pair of plate members which respectively form the front and rear of the fitting band, and the inner piece member comprises only one plate member which has the opening and is formed by folding into a substantially U-shape at the opening.

Further, a connecting member for rotatably connecting a pair of adjacent piece members may sometimes be provided. In this case, the connecting member is preferably connected by a bridge-like portion which is extended in the widthwise direction on the front side of the fitting band. The connecting member is preferably integrally provided with engaging arms, each of which is a bent projection with engaging ends which engage each of the piece members along the rotational axis thereof.

In each of the above means, each of the conductive members is preferably bent in a direction crossing the direction of extension thereof so as to be able to expand and contract in the direction of extension, and an insulating coating is preferably formed around each of the conductive members without interfering with expansion and contraction.

Since the base is rotatably connected to the end piece, the base rotates by its own weight when being set on an arm, and the fitting properties are improved. In addition, since the conductive members are held by the end piece, and rotatably disposed with respect to the base, even if the fitting band is deformed, the stress applied to the connection portion between the case and the conductive members can be decreased, and the stress and deformation applied to the internal conductive members can also be decreased, thereby improving electrical durability, reliability and safety.

Since the end piece is fixed to the case, the conductive members are not subjected to deformation and load in the connection portion between the case and the fitting band, and durability of the conductive members can thus be ensured. Further, the design of the mounting portion of the case can freely be determined using not only the "Roof-attached Horn style" structure but also as a "Tow Horn style" structure or a structure "without a horn", thereby decreasing the limitations on design.

Since the hollow members are arranged along the rotation axis, even if the base is rotated, the deformation of the conductive members passed therethrough can be suppressed, and the positions of the conductive members in the direction of extension of the fitting band can be maintained. Thus, a local load or a large deformation is not applied to the conductive members, and durability, reliability and safety can be increased.

Since each of the hollow members comprises a cylindrical connecting shaft so as to have the function to position and support the conductive members and the rotatable connection function, the connecting structure is simplified, the number of parts is decreased, and the assembly becomes easy.

The portions between the respective piece members which form the base have the same functions and effects as those described above.

Since an auxiliary secondary battery is provided in the band, the storage capacity can be increased without limiting the housing capacity, and excess electric power which cannot be stored in the secondary battery in the watch case can be stored in the auxiliary secondary battery. Thus, the operation time with no generation of power can be increased, and the opportunity of discarding electric power in order to prevent overcharging is significantly decreased, as compared with conventional structures.

The connection of the auxiliary secondary battery is intermitted by the selective switching circuit so that the synthetic capacity of the secondary battery and auxiliary secondary battery can be adjusted by an operating member such as an operating button or the like or the control, if required, and accidents such as cutting of wire, short-circuit and so on on the side of the auxiliary secondary battery can be coped with.

A current limiter can prevent a voltage drop on the side of the watch case during charging of the auxiliary secondary battery.

The insulating surrounding members can reliably achieve insulating properties in the portions where the conductive members are respectively passed, and prevent poor insulation caused by adhesion of sweat or water.

Since the insulating surrounding members are fixed to the case with a gap between the conductive member and insulating surrounding member and are provided with flexibility, even if the insulating surrounding members are deformed due to rotation of the fitting band, only a little stress is applied to the conductive members, and it is thus possible to prevent occurrence of poor insulation and disconnection of the conductive members.

Since a projecting seal portion is integrally provided so that the insulating surrounding members ensure insulating properties and waterproofness in the portions where the conductive members are respectively passed, it is possible to prevent poor insulation or deterioration in durability caused by corrosion with a liquid, and to facilitate assembly work in the portions where the conductive members are respectively passed.

A member's coating portion is integrally provided on each of the insulating surrounding members so as to also function as an insulating coating for each of the conductive members in the direction of extension thereof.

Since the ends of the conductive members can be securely connected to an electronic function member in the fitting band without providing enlarged-diameter portions at the ends, such as the insulating surrounding members, sealing portions or terminals, the conductive members can be passed through after the fitting band is produced, thereby facilitating the assembly work.

Since a plurality of piece members which form the fitting band are connected to each other with a rotation angle within a limited range, it is possible to prevent application of a large local deformation to the conductive members passed through the fitting band, and to attempt to prevent a disconnection accident and improve durability. Specific structures of such a fitting band include are described herein. In these structures, the fitting band is assembled so as to be rotatable at least within a predetermined range without limiting the movement of the conductive members passed therethrough. The design of the inner piece members can easily be changed. An attempt can be made to decrease production cost without increasing the number of parts. Since the connecting portions between the respective piece members can be covered by the bridge-like portions, the gaps between the respective piece members can freely be changed while preventing exposure of the conductive members. Since the engaging arms are integrally provided on the connecting member, there is no need to prepare another engaging member for connection, which thereby decreases the number of parts.

Since the conductive members are formed so as to be capable of expansion and contraction in the direction of extension thereof, and the insulating coating is provided without interfering with expansion and contraction, it is possible to prevent damage such as cracking and cutting of the conductive members, which are caused by deformation of the fitting band, and improve durability.

BRIEF DESCRIPTION OF THE DRAWINGS

FIG. 32 is a perspective view illustrating examples of the constructions of inner piece members in accordance with Embodiment 9 of the present invention;

FIG. 37 is an exploded perspective view illustrating another different example of the band structure of Embodiment 9;

FIG. 38 is a perspective view illustrating the assembly of the same band;

BEST MODE FOR CARRYING OUT THE INVENTION

Electronic apparatus having a fitting band in accordance with embodiments of the present invention are described below with reference to the attached drawings.

[Embodiment 1]

Figure 1:
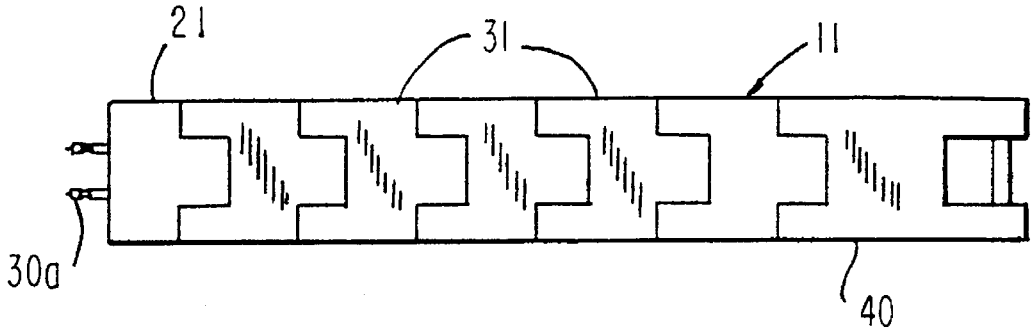
FIG. 1 is a plan view illustrating a structure of a band in accordance with Embodiment 1 of the present invention.
Figure 2:
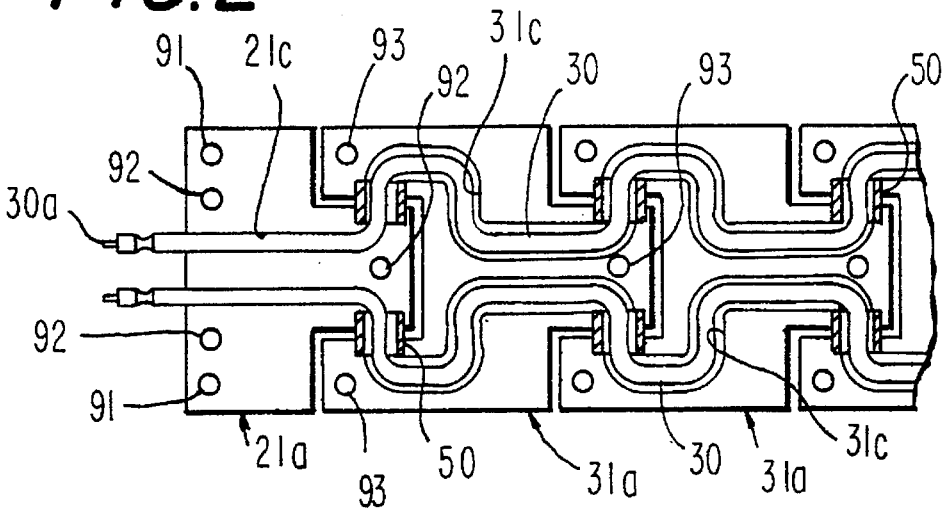
FIG. 2 is an exploded plan view illustrating the internal structure of the band in the same embodiment.

FIGS. 1 to 4 illustrate an electronic apparatus in accordance with Embodiment 1 of the present invention. As illustrated in FIG. 1, a band 11 comprises a metallic end piece 21, a plurality of piece members 31 which are connected to each other to form a base, and a sensor box 40 attached to the side of the band opposite the end piece 21. As illustrated in FIG. 2, the band 11 contains a pair of conductive wires 30 as conductive members which are lead wires each of which is coated with an insulator such as a synthetic resin. The end of each of the conductive wires 30 has a ring groove which is formed by circumferentially melting the insulating coating, for example, by using a heated trowel, the tip of each of the wires without the insulating coating being fixed by solder.

Figure 3:
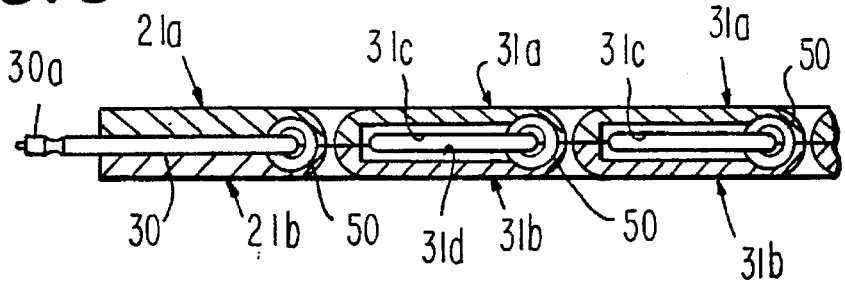
FIG. 3 is a longitudinal sectional view illustrating the internal structure of the band in the same embodiment.

As illustrated in FIG. 3, the end piece 21 comprises end piece plates 21*a* and 21*b*, and each of the piece members 31 comprises piece plates 31*a* and 31*b*. End piece plate 21*a* is formed with threaded holes 91 for mounting a case, and threaded holes 92 for fixing the end piece plates, as illustrated in FIG. 2. End piece plate 21*b* is formed with through holes corresponding to the threaded holes 91, and through holes with counterbores (not shown) at positions corresponding to the threaded holes 92. Each of the end piece plates 21*a* and 21*b* is provided with recessed portions 21*c* for containing the conductive wires 30 and pipes 50 which will be described below. Each of the piece plates 31*a* has three threaded holes 93, and through holes (not shown) formed at positions corresponding to the threaded holes 93 of each of the piece plates 31*b*. Each of the piece plates 31*a* and 31*b* also has recessed portions 31*c* and 31*d* for containing the conductive wires 30 and the pipes 50.

The metallic pipes 50 are contained between the end piece 21 and the piece member 31 and between the respective adjacent piece members 31 so as to be oriented in the direction crossing at right angles the direction of extension of the band 11, the conductive wires 30 being passed through the pipes 50. Each of the conductive wires 30 is extended while snaking and passing through the pipes 50 in the band, and conductively connected to a sensor contained in the sensor box 40. The pipes 50 are rotatably held between the end piece 21 and the piece members 31 so as to rotatably connect the end piece and the piece member 31 and to connect the respective adjacent piece members 31.

The band 11 is assembled as described below. After the end piece plate 21*a*, a required number of piece plates 31*a* and the sensor box 40 are arranged in a plane, the terminal portions of the conductive wires 30 are passed through a required number of pipes 50 and are respectively set in the recessed portions 21*c* of the end piece plate 21*a*. The pipes 50 through which the conductive wires 30 are respectively passed are arranged in the connection portion between the end piece plate 21*a* and the piece plate 31*a*, and the end piece plates 21*a* and 21*b* are screwed together. The conductive wires 30 are then set in the recessed portions 31*c* of each of the piece plates 31*a*, the pipes 50 through which the conductive wires are respectively passed are arranged in the connection portion between the adjacent piece plates 31*a*, and the piece plates 31*a* and 31*b* are then screwed together. The other piece plates are successively screwed together in the same way as that described above. Finally, packings (not shown) are set to the other ends of the conductive wires 30, which have the same shape as that of the ends 30*a*, and the conductive wires 30 are forced into the conducting holes formed in the sensor box 40 together with the packings.

Figure 4:
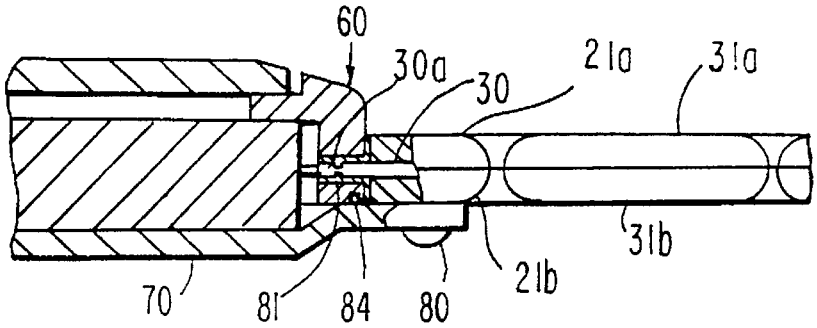
FIG. 4 is a schematic sectional view illustrating a structure for mounting the band on a case in the same embodiment.

As illustrated in FIG. 4, the wrist watch case comprises a case band 60 and a case back 70, the case band 60 having conducting holes formed in a side thereof so as to contain the ends 30*a* of the conductive wires 30. The lower side of the case band 60 is provided with a groove for containing a packing 84 therein and threaded holes (not shown) for mounting the case back 70. The case back 70 has through holes (not shown) for screwing the case back 70 to the case band 60, and through holes (not shown) for mounting the end piece 21. The case back 70 is formed at the bottom of the case band 60 so as to partly project from the case band 60 in the directions of 12 o'clock and 6 o'clock of the watch.

The band is mounted on the wrist watch case by forcing the ends 30*a* of the conductive wires 30, which project from the end piece 21, into the conducting holes of the case band 60 together with the packings 81 and then fixing the end piece 21 and the case back 70 together by screws 80. The conductive wires 30 passed through the end piece 21 are preferably pressed by the recessed portions 21*c* for containing the wires 30 or bonded to the insides of the recessed portions 21*c* so as to be held in the direction of extension thereof. Since the conductive wires 30 are held in the end piece 21, the ends 30*a* of the conductive wires 30 introduced into the case band 60 are fixed to the case band 60 even if the band is deformed, thereby ensuring durability of the connection portion of the conductive wires 30.

Since the band 11 is mounted on each of the sides of 12 o'clock and 6 o'clock of the wrist watch case, one of the bands is the above band 11 containing the conductive members, and the other band can be formed as an ordinary band and can be provided with a band length adjusting mechanism, for example, using a hair pin or the like. When the length of the band 11 containing the conductive member is adjusted, a known free adjustment-type mechanism generally used for wrist watch bands may be used.

[Embodiment 2]

Figure 5:
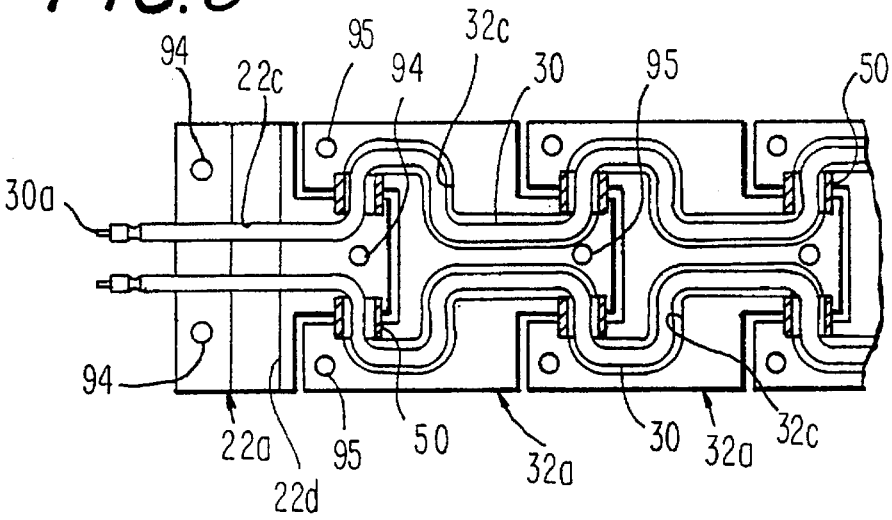
FIG. 5 is an exploded plan view illustrating the internal structure of a band in accordance with Embodiment 2 of the present invention.
Figure 6:
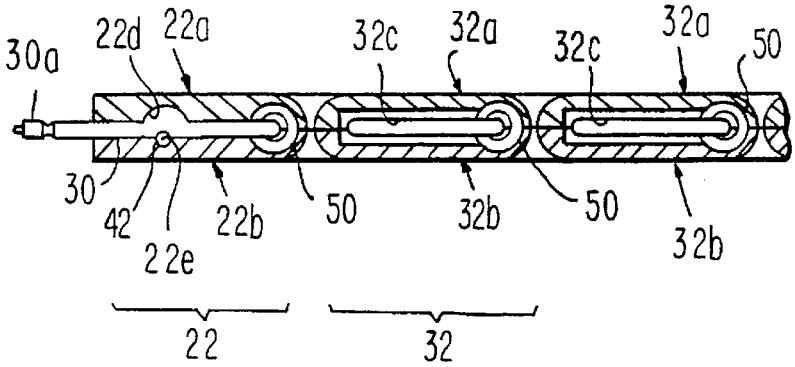
FIG. 6 is a longitudinal sectional view illustrating the internal structure of the band in the same embodiment.
Figure 7:
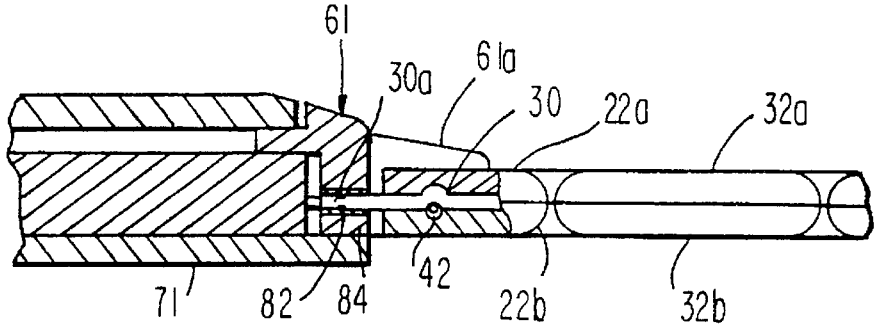
FIG. 7 is a schematic sectional view illustrating a structure for mounting the band on a case in the same embodiment.

FIGS. 5 to 7 illustrate Embodiment 2 of the present invention. An end piece 22 comprises end piece plates 22*a* and 22*b*, the end piece plate 22*a* having threaded holes 94 corresponding to the through holes (not shown) formed in the end piece plate 22*b*. The end piece plate 22*a* also has the same recessed portions 22*c* as those of Embodiment 1, which are formed in the direction of extension of the conductive wires 30 so as to contain the wires 30, and a groove 22*d* formed at right angles to the recessed portions 22*c*. Further, piece plates 32*a* and 32*b* have a recessed portion 32*c* so as to contain the conductive wires 30. As illustrated in FIG. 6, the end piece plate 22*b* has a groove 22*e* formed for containing a spring bar 42. The groove 22*e* is formed for containing the spring bar 42, and the groove 22*d* is formed for containing the curved portions of the conductive wires 30, which are formed by overpassing the spring bar.

The end piece 22 is connected to a piece member 32 comprising piece plates 32*a* and 32*b*, as described above. The piece plate 32*a* has the same structure as that of the piece plate 31*a* of Embodiment 1 in which threaded holes 95 corresponding to through holes (not shown) formed in the piece plate 32*b*, which is the same as the piece plate 31*b*, are formed.

As illustrated in FIG. 7, the wrist watch case comprises a case band 61 and a case back 71, conducting holes for introducing the conductive wires 30 being formed in a side of the case band 61, and the lower surface of the case band 61 has a groove formed for containing a waterproof packing 84. The case band 61 has joggle grooves (not shown) formed on the inner side of the case band 61 so as to engage the joggles (not shown) formed on the case back 71, the joggles being fitted in the joggle grooves.

The band is mounted on the wrist watch case by the method described below. The end piece 22 of the band is assembled by the same method as that in Embodiment 1 except that the spring bar 42 contained in the groove 22*e* of the end piece plate 22*b* is held in a "horn" 61*a* (not shown) of the case band 61 by pushing the ends of the spring bar 42, and is moved along the direction of projection of the "horn" 61*a*. Packings 82 are then set at the ends 30*a* of the conductive wires 30 which project from the end surface of the end piece 22. The ends 30*a* to which the packings 82 are set are forced into the conducting holes of the case band 61, and the ends of the spring bar 42 are then engaged in the "horn holes" of the "horn" 61*a*.

It is desirable from the viewpoint of ensuring waterproofness that the end piece 22 has dimensions which can prevent as much as possible looseness between the side of the case band 61 and the spring bar 42, and that the rotation of the end piece 22 caused by rotation of the band is restricted as much as possible by bringing the upper portion of the end piece plate 22*a* and the lower portion of the end piece plate 22*b* in the direction of thickness of the band into contact with the side of the case band 61.

[Embodiment 3]

Figure 8:
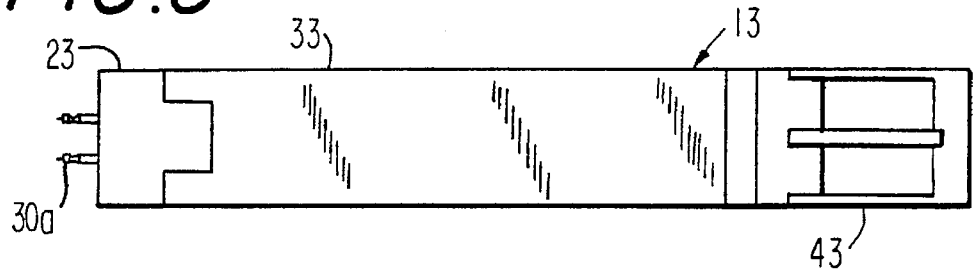
FIG. 8 is a plan view illustrating a structure of a band in accordance with Embodiment 3 of the present invention.
Figure 9:
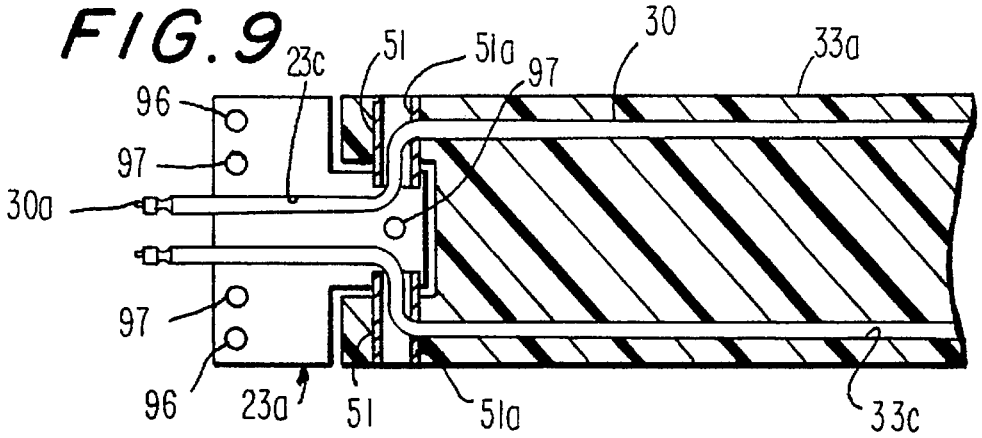
FIG. 9 is an exploded plan view illustrating the internal structure of the band in the same embodiment.
Figure 10:
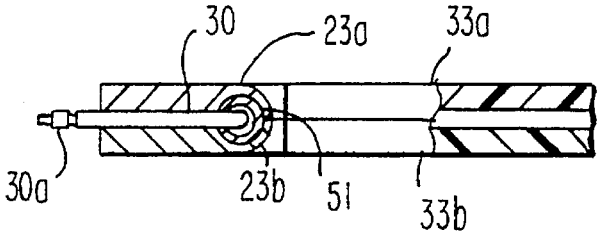
FIG. 10 is a longitudinal sectional view illustrating the internal structure of the band in the same embodiment.

FIGS. 8 to 10 illustrate Embodiment 3 of the present invention. Embodiment 3 relates to a band 13 made of a material such as natural leather, artificial leather or a synthetic resin. The band 13 has a metallic or non-metallic end piece 23, comprising end piece plates 23*a* and 23*b*, and a base 33 made of a material such as natural leather, artificial leather or a synthetic resin, and comprising a surface member 33*a* and a rear member 33*b*, and a buckle 43.

In each of the end piece plates 23*a* and 23*b* are formed recessed portions 23*c* for containing the conductive wires 30 and pipes 51. The end piece plate 23*a* is provided with threaded holes 96 for mounting on a wrist watch case and threaded holes 97 for fixing the end piece plates together, and the end piece plate 23*b* is provided with through holes corresponding to the threaded holes 96 and through holes with counterbores (not shown) corresponding to the threaded holes 97.

Each of the surface member 33*a* and the rear member 33*b*, which form the base 33, is made of a resin, e.g., urethane rubber, and recessed portions 33*c* for containing the conductive wires 30 and the pipes 51 and a recessed portion for containing a sensor unit (not shown) are formed in molding the base 33. The base 33 is assembled by setting the pipes 51 through which the conductive wires are passed, the conductive wires 30 and the sensor (not shown) in molded portions of the rear member 33*b*, and then bonding the surface member 33*a* to the rear member 33*b*. The pipes 51 and the conductive wires 30, which project from the base 33, are then arranged in the end piece plate 23*a*, and the end piece plates 23*a* and 23*b* are screwed together. The buckle 43 is attached at the time of bonding the surface member 33*a* to the rear member 33*b*.

The pipes 51 are respectively extended to portions near the widthwise ends of the base 33 so as to sufficiently resist the loads applied to the band, such as twisting moment, tensile force and so on. The pipes 51 have notches 51*a* which are formed on the side opposite to the end piece so as to bend the conductive wires 30 at the notches 51*a* and dispose the wires 30 in the base 33. This can increase the strength of the connection between the end piece 23 and the base 33 and maintain the shape of the connecting portion of the base 33. The end piece 23 may be made of either a metallic or non-metallic material. The recessed portions 23*c* and the recessed portions 22*c* of Embodiment 2 have the same size as that of the recessed portions 21*c* of Embodiment 1. The length of the band is adjusted by selecting a hole formed in another base which engages the buckle 43, as in normal cases.

[Embodiment 4]

Figure 11:
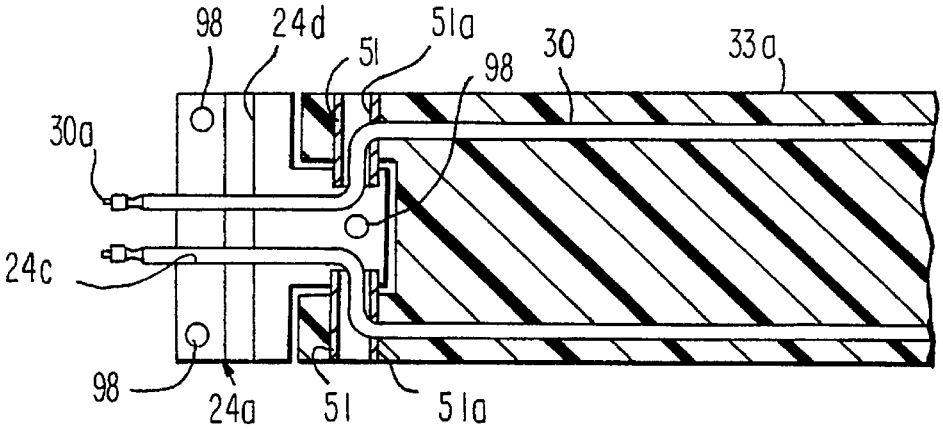
FIG. 11 is a exploded plan view illustrating the internal structure of a band in accordance with Embodiment 4 of the present invention.
Figure 12:
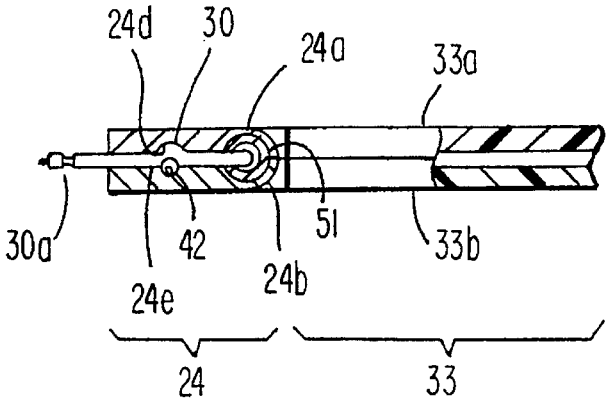
FIG. 12 is a longitudinal sectional view illustrating the internal structure of the band in the same embodiment.

FIGS. 11 and 12 illustrate Embodiment 4 of the present invention. Although Embodiment 4 is provided with the same base 33 as that of Embodiment 3, Embodiment 4 differs from Embodiment 3 in a structure in which spring bar 42 is passed through an end piece 24. The end piece 24 comprises end piece plates 24*a* and 24*b*, and the end piece plate 24*a* has threaded fixing holes 98 which correspond to the through holes (not shown) formed in the end piece plate 24*b*. The end piece plate 24*a* is also provided with recessed portions 24*c* for the conductive wires 30, and a groove 24*d* for containing the curved portions of the conductive wires 30, and the end piece plate 24*b* is provided with a groove 24*e* for containing the spring bar 42. The structures of other recessed portions for containing the conductive wires, the method of assembling the band and the method of mounting the band on the case are the same as in Embodiments 1 or 3.

Although each of the above embodiments relates to the band structure and band mounting structure of, as an example, an electronic wrist watch having a band containing a sensor for measuring blood pressure, pulse or bodily temperature, the present invention is not limited to such sensors. The present invention can be applied to any apparatus having a band containing a conductive member, such as a band where conductive wires are disposed in the band for containing a communication antenna or secondary battery, which will be described below, in the band.

[Embodiment 5]

Figure 13:
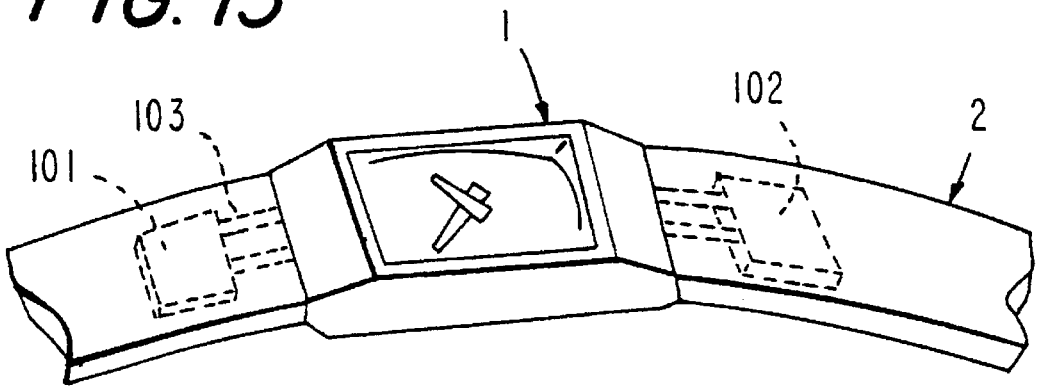
FIG. 13 is a perspective view illustrating the whole structure of Embodiment 5 of the present invention.

Description will now be made of an embodiment in which a secondary battery is contained in a band of a wrist watch in accordance with each of the above embodiments. As illustrated in FIG. 13, this embodiment relates to an electronic wrist watch roughly comprising a watch case 1 containing a watch driving device, a generating device and a secondary battery, and a band 2 comprising leather, a resin or a plurality of metallic piece members which are connected to each other. In this embodiment, secondary batteries 101 and 102 are contained in the band 2 near the watch case, and connected to the watch case by conductive wires 103. Although various batteries can be used as the secondary batteries 101 and 102, electric double layer capacitors are preferred from the viewpoint of the allowable number of times of charging and discharging, and polyacene lithium capacitors are preferred from the viewpoints of voltage recovery properties and energy density. A single secondary battery may be provided, or any desired number of batteries may be provided according to demand.

Figure 14:
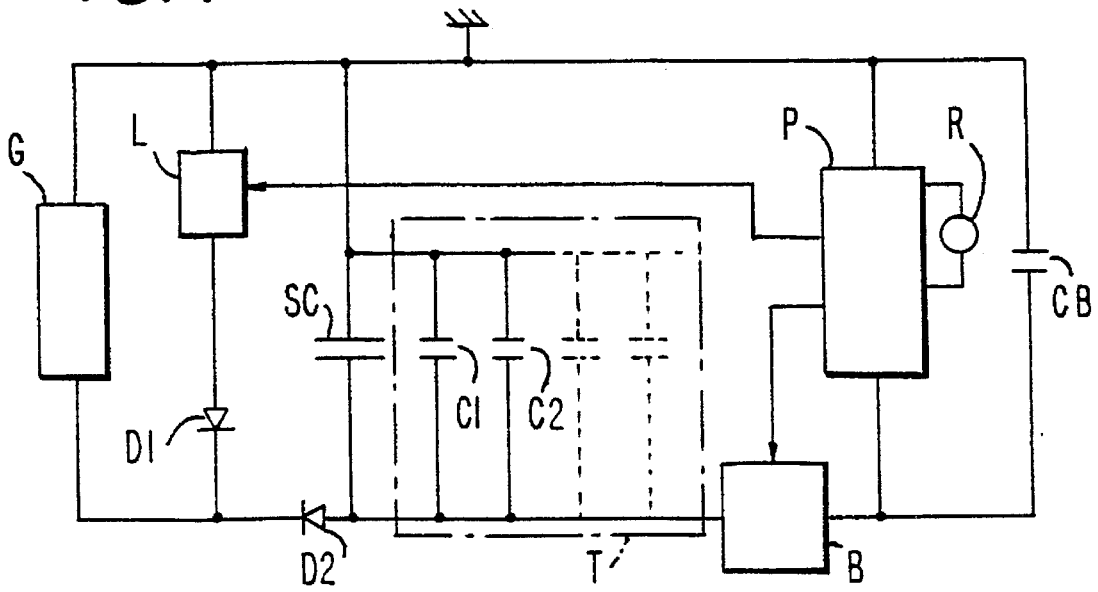
FIG. 14 is a schematic view illustrating the circuit configuration of an example of an electric power supply system in the same embodiment.

FIG. 14 illustrates the circuit of an electric power supply system of this embodiment. In a generating device G, a rotor is rotated by the torque of an oscillating weight to generate electromotive force in an electromagnetic coil to obtain output current, as described below. A limiter circuit L and a reverse-current preventing diode D1 are connected in parallel to the generating device G. The limiter circuit L is a circuit for preventing overcharging of the secondary batteries. A rectifying diode D2 performs half-wave rectification of the AC current generated in the electromagnetic coil and prevents reverse current.

A large-capacity capacitor SC, which is connected in parallel to the generating device G and the limiter circuit L, is a secondary battery contained in the watch case so as to store the electric power generated by the generating device G. A control driving circuit P comprises an integrated circuit for driving a driving motor (or a display) R for the watch and for controlling the limiter circuit L, and a booster circuit B and a selective switching circuit SW, both of which will be described below. Reference character CB denotes a backup capacitor for the control driving circuit P.

An internal band portion T is a portion contained in the band 2 shown in FIG. 13 and comprising internal band capacitors C1 and C2 serving as auxiliary secondary batteries and connected in parallel to the large-capacity capacitor SC contained in the watch case.

The booster circuit B is a circuit for boosting the electric power generated by the generating circuit G and stored in each of the secondary batteries to the working voltage of the control driving circuit P. Since the output voltage of the capacitors from each of the secondary batteries significantly changes with the charging amount, the voltage on the side of the control driving circuit P and the backup capacitor CB is increased by, for example, 2 or 3 times, in accordance with the output voltage of the capacitor in order to constantly maintain the operation of the control driving circuit P. Typical examples of the configuration of the circuit are disclosed in Japanese Laid-Open Patent Nos. 60-203887 and 61-124887.

This embodiment is practical in that the storage capacity can be increased by a simple circuit configuration, and can be applied to the configuration of an internal circuit of an ordinary watch case without any change. However, since the time required for charging to a predetermined output voltage is increased, a circuit configuration for ensuring a driving voltage by the booster circuit B is indispensable.

Figure 15:
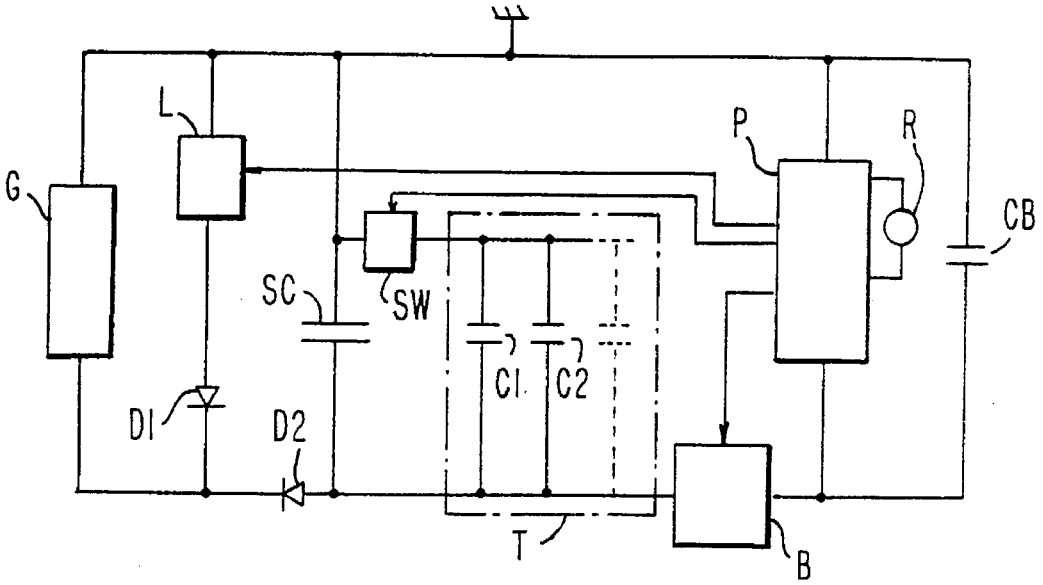
FIG. 15 is a schematic view illustrating the circuit configuration of another example of an electric power supply system in the same embodiment.

FIG. 15 illustrates a configuration in which the internal band portion T can be connected and disconnected by the selective switching circuit SW. The selective switching circuit SW selectively changes the connection state between the circuit part of the watch case and the internal band portion T based on a command from the control driving circuit P. A simple opening/closing switch which operates by a control signal from the control driving circuit P, or a circuit which opens and closes on the basis of the voltage or current it detects, may be used as the selective switching circuit. Although the selective switching circuit SW is generally provided in the IC of the watch case, it can comprise another IC so as to be provided in the band.

In this embodiment, when the large capacity capacitor SC is charged, the control driving circuit P outputs a closing signal to the selective switching circuit SW in order to prevent overcharging to connect the internal band portion T to the case circuit. Thus, the synthetic capacity is increased by connection of the internal band capacitors C1 and C2, thereby preventing overcharging and further charging the capacitor. When the output voltage of the secondary batteries is decreased to a level lower than the allowable lowest voltage of the watch, an opening signal is transmitted to the selective switching circuit SW so that the band internal capacitors C1 and C2 are disconnected. In the selective switching circuit SW, the charging current is detected, and particularly, the charging current at the start of charging is limited to a predetermined value or less to prevent a voltage drop on the case side and to prevent consumption of electric power by opening the circuit, for example, when an accident such as a short-circuit of the internal band capacitors or internal band wiring occurs. When an accident such as a disconnection or short-circuit occurs in the internal band portion T, an alarm can be given by a display or by a sound generator provided on the side of the watch case.

Even if all secondary batteries are charged, when a danger of overcharging occurs, the limiter circuit L is operated, as in a conventional watch. However, since the limit on at least the containment volume is significantly reduced by providing the secondary batteries in the band, the opportunity of occurrence of such a danger is significantly decreased.

In this way, when the amount of electricity stored is small, the auxiliary secondary batteries are disconnected by the selective switching circuit for intermittent connection between the internal band portion T and the circuit portion of the case, so that the voltage can be maintained by decreasing the capacity of the secondary batteries. When the amount of the electricity stored is large, the capacity of the secondary batteries is increased by connecting the auxiliary secondary batteries in the band so that the generated electric power can be stored, not discarded. It is also possible to prevent a voltage drop on the case side by disconnecting the selective switching circuit during charging, and to automatically avoid cessation of the functioning of the watch case by disconnecting the selective switching circuit when an accident such as a short-circuit occurs in the band.

Figure 16:
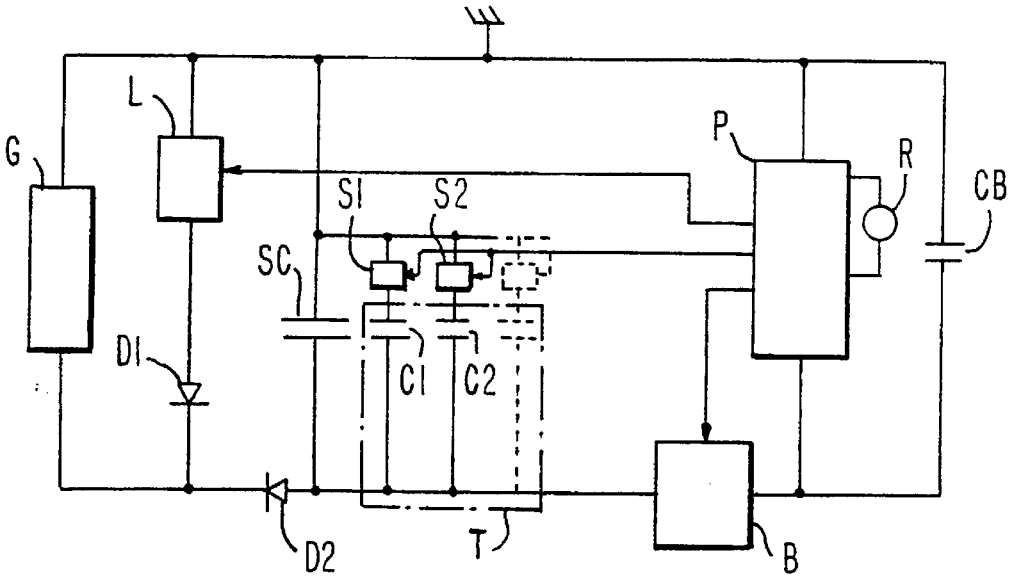
FIG. 16 is a schematic view illustrating the circuit configuration of a further example of an electric power supply system in the same embodiment.

The characteristics of this embodiment apply to the modified embodiment shown in FIG. 16. The modified embodiment is different from the above embodiment only in the point that selective switching circuits S1 and S2 are connected in series to the corresponding internal band capacitors C1 and C2, respectively, of the band internal T. Each of the selective switching circuits S1 an S2 has the same function as that of the selective switching circuit SW, and is generally provided in the IC of the watch case. Each of the selective switching circuits S1 and S2 may, of course, be contained as another IC in the band. The modified embodiment improves controllability, particularly when many auxiliary secondary batteries are disposed in the band, or when each of the auxiliary secondary batteries has a large capacity. For example, the embodiment is effective in that the voltage on the case side can be maintained by adjusting the capacity of each of the auxiliary secondary batteries, and that only the auxiliary secondary battery which produces an accident of the plurality of auxiliary secondary batteries can be disconnected.

Figure 17:
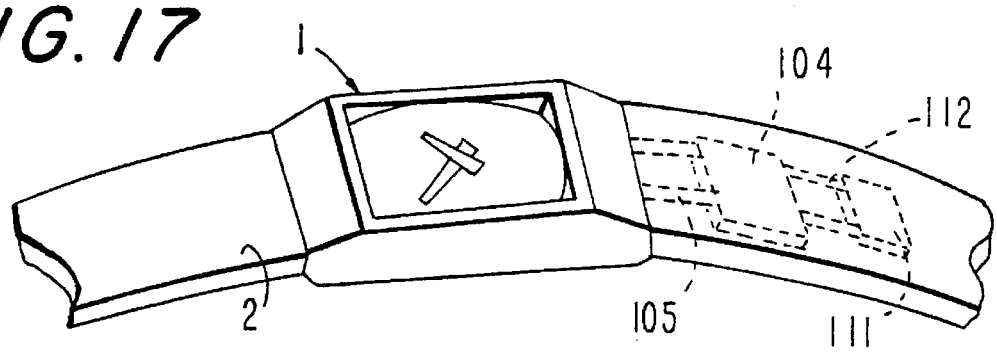
FIG. 17 is a perspective view illustrating the whole construction of a modified embodiment of Embodiment 5 of the same embodiment.
Figure 18:
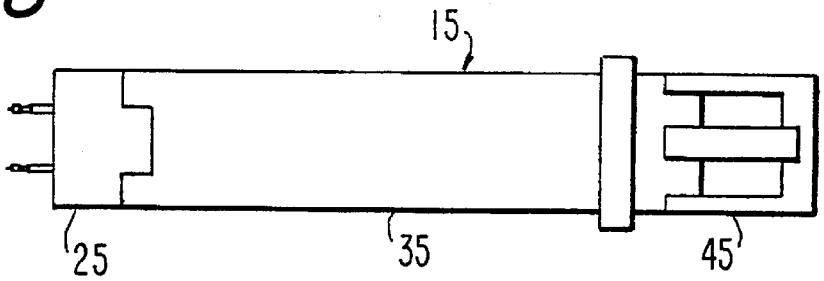
FIG. 18 is a view illustrating the whole construction of an example of the band structure in the same embodiment.
Figure 23:
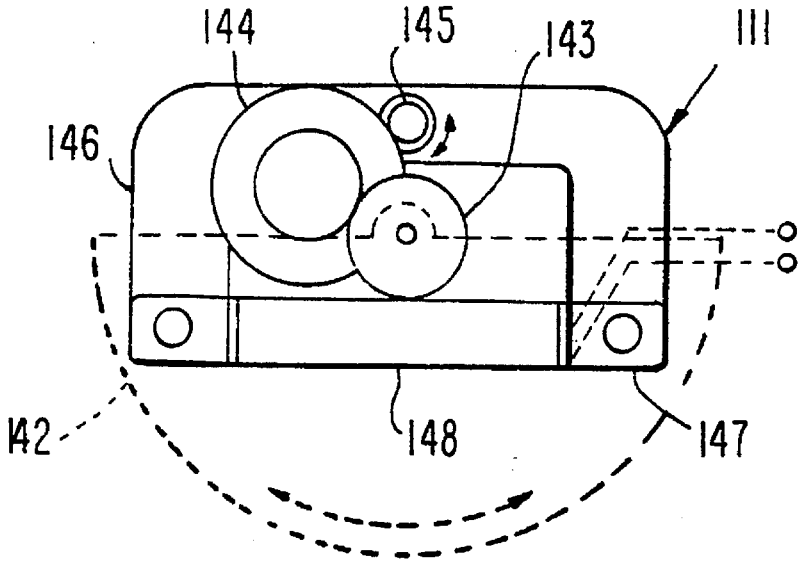
FIG. 23 is a view illustrating the internal structure of a generating device applied to the modified embodiment shown in FIG. 16.

FIG. 17 illustrates another modified embodiment in which a generating device 111 similar to the generating device G shown in FIGS. 14 and 15 is contained together with a secondary battery 104 in the same band 2 as that of the electronic wrist watch shown in FIG. 13. The generating device 111 and the secondary battery 104 are connected to each other by conductive wires 112, and the secondary battery 104 and the watch case are connected to each other by conductive wires 105. As illustrated in FIG. 23, the generating device 111 comprises an oscillating weight 142 having an eccentric weight distribution, a rotor 145 connected to an oscillating weight 142 through speed-up gear trains 143 and 144 and magnetized in the rotational direction, a U-shaped plate stator 146 containing the rotor 145 in the through hole thereof, coil core 147 respectively screwed to both ends of the stator 146, and an electromagnetic coil 148 wound around the coil core 147. The secondary battery 104 and the generating device 111 are contained in a space provided in the band. When the band itself is made of a conductor, each of the secondary battery 104 and the generating device 111 is contained in an insulating case and disposed in the band.

FIGS. 18 to 22 illustrate the structure of a band suitable for a case where the secondary battery of the above embodiments is contained in the band. The band 15 shown in FIG. 18 roughly comprises an end piece 25 which is connected to the watch case and preferably made of a metallic material, and a base 35 which is rotatably connected to the end piece 25, forming a principal portion of the band, and preferably made of leather or synthetic resin. The end piece 25 comprises end piece plates 25*a* and 25*b* (not shown), and the base 35 comprises a surface member 35*a* and a rear member 35*b* (not shown).

Figure 19:
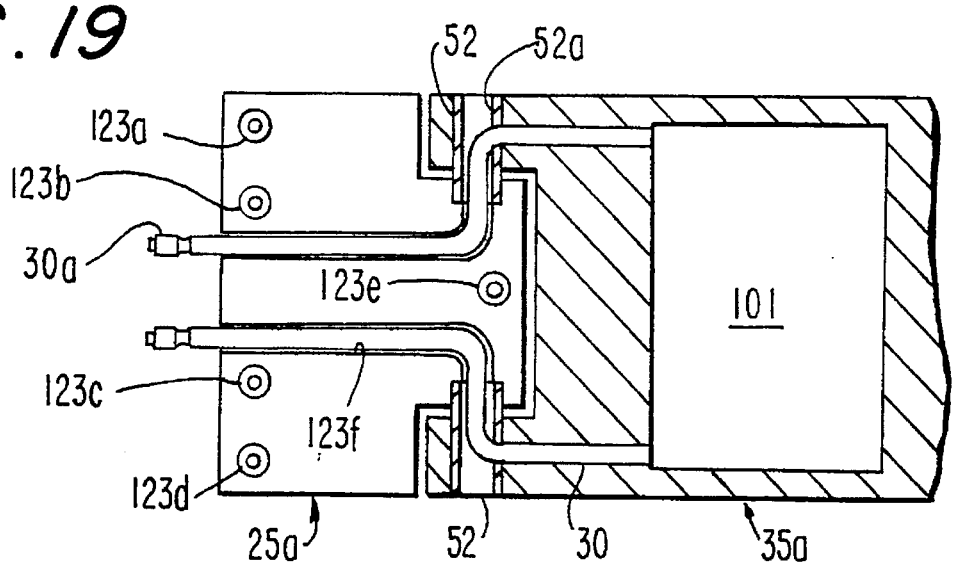
FIG. 19 is a view illustrating details in the same band.

As illustrated in FIG. 19, the end piece plate 25*a* has threaded holes 123*a* and 123*d* for fixing to the case, and threaded holes 123*b*, 123*c* and 123*e* for fixing to the end piece plate 25*b*. The end piece plate 25*a* also has recessed portions 123*f* for containing the conductive wires 30 and pipes 52. The end piece plate 25*b* has through holes (not shown) and counterbores (for preventing the top of a fastening bolt from projecting from the bottom of the end piece plate 25*b*, not shown) at positions corresponding to the threaded holes 123*b*, 123*c* and 123*e* of the end piece plate 25*a*. The end piece plate 25*b* also has recessed portions formed on the upper side thereof, which are the same as the recessed portions 123*f* of the end piece plate 25*a*.

Each of the conductive wires 30 comprises a lead wire coated with an insulating resin, and has a ring groove formed in the periphery of the insulating coating at the end 30*a* connected to the watch case in order to engage a packing in the connection portion, the insulating coating at the tip thereof being removed. The connecting pipes 52 are rotatably fitted in the recessed portions of the end piece 25, and fixed and bonded between the front member 35*a* and the rear member 35*b* of the base 35, the conductive wires 30 being respectively passed through the pipes 52. The pipes are extended to the side edges of the base 35 in order to connect and reliably support the connection portion of the base 35. However, a notch portion 52*a* is formed on the side of each pipe 52 opposite to the end of the piece 25, so that the conductive wires 30 are introduced into the base 35 from the notched portions 52*a*. In the base 35, the conductive wires 30 and the secondary battery 101 are held and bonded. A selective switching circuit or opening/closing switch may be contained in a secondary battery 101, or an exclusive selective switching circuit may be contained independently in the base. These circuits may, of course, be contained in the watch case.

The connecting pipes 52 rotatably connect the end piece 25 and the base 35, and fix the conductive wires 30 in the end piece 25 in the direction of extension thereof so as to prevent application of loads to the ends 30*a* connected to the watch case. The notches 52*a* permit the conductive wires 30 to slightly move in the direction of extension thereof within the base 35.

Figure 20:
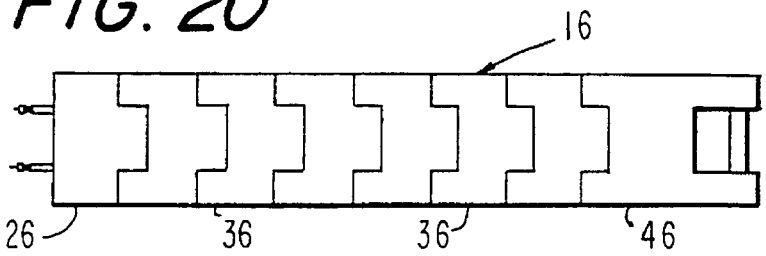
FIG. 20 is a view illustrating the whole construction of another example of the band structure in the same embodiment.
Figure 21:
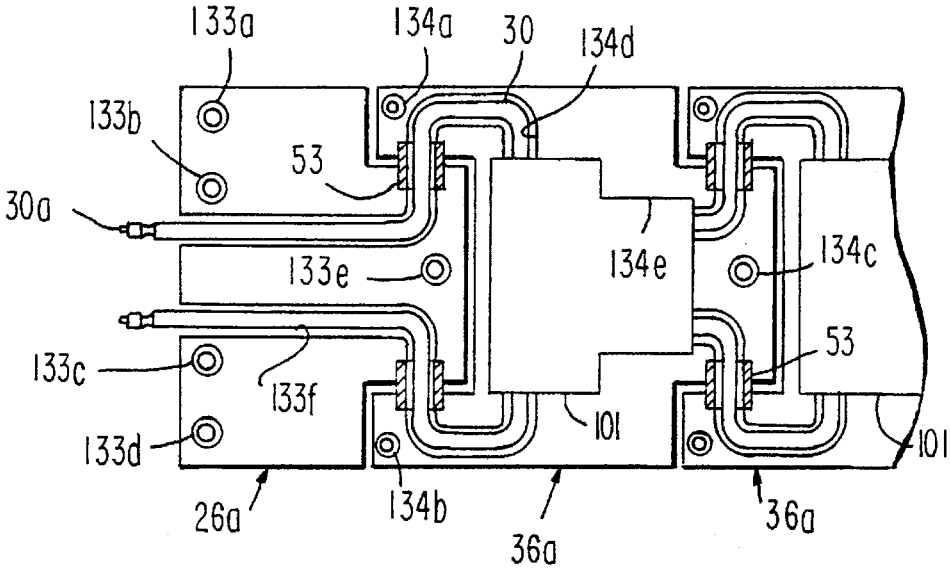
FIG. 21 is a view illustrating details of the same band.

FIG. 20 illustrates an embodiment in which a band 16 has a base comprising a plurality of metallic piece members 36 connected to each other. Since an end piece 26 is the same as the end piece 25, description of the end piece 26 is omitted. Each of the piece members 36 comprises piece plates 36*a* and 36*b* (not shown). The piece plate 36*a* has threaded holes 134*a*, 134*b* and 134*c* for fixing to the piece plate 36*b*, as shown in FIG. 21. Recessed portions 134*d* for containing the conductive wires 30 and pipes 53, and a recessed portion 134*e* for containing the secondary battery 101 are also formed on each of the piece plates 36*a*. Similarly, these recessed portions are formed on each of the piece plates 36*b*. Each of the piece plates 36*b* has through holes (not shown), and counterbores (not shown) for preventing the top of a fastening bolt from projecting from the bottom of the rear member 36*b* at positions corresponding to the threaded holes 134*a*, 134*b* and 134*c* of each of the piece plates 36*a*. The cylindrical pipes 53 rotatably engage the recessed portions of the end piece and the piece member to rotatably connect both. The secondary battery 101 is contained in an insulating case or is contained in the recessed portion 134*e* into which an insulating sheet is applied.

Figure 22:
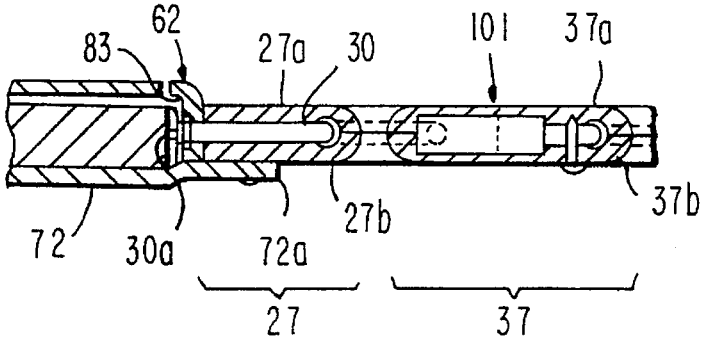
FIG. 22 is a sectional view illustrating an example of the connection portion between the watch case and the band in the same embodiment.

FIG. 22 illustrates a connection portion between an end piece 27 which forms a band and a case band 62 of the watch case. This applies to the embodiments shown in FIGS. 18 to 21. The band comprises the end piece 27 and a plurality of piece members 37 connected to each other. Since the band is substantially the same as that shown in FIG. 19, description thereof is omitted. A side of the case band 62 is provided with conducting holes for introducing the ends 30*a* of the conductive wires into the connection portion between the end piece 27 and the case band 62. The wires 30 are inserted into the conducting holes, and the ends thereof are connected to connecting terminals in the watch case and fixed in the state where each of the packings 83 engages a ring groove. A case back 72 of the watch case has a supporting portion 72*a* sidewardly extended so that the end piece 27 is disposed on the supporting portion 72*a* and screwed thereto. The structure for mounting the end piece is not limited to the above fixed structure; the end piece may be indirectly connected through a spring bar.

In this way, the base is rotatably connected to the end piece which is connected to the watch case, and the pipes through which the conductive wires are passed are arranged in parallel to the rotation axis, thereby preventing application of loads to connection points thereof on the case side and to connection points of the conductive wires on the side of the secondary battery without interfering with the fitting properties of the band. In addition, since the pipes are used as connecting shafts, the number of parts is decreased, and assembly becomes easy.

Although, in the above embodiments, the present invention is applied to an electronic wrist watch, the present invention can be applied to any electronic apparatus having a fixing band for fitting to an arm or another part of the human body and having the function as an electronic sphygmomanometer, a communication device or an electronic pocket notebook. Further, a solar cell and other known generating mechanisms may, of course, be used as the generating device.

Description will now be made of the detailed constructions of electronic wrist watches in accordance with different embodiments which are mainly produced in consideration of a waterproofing structure and the durability of a band. First, a plurality of embodiments relating to the coating structure and connection structure of a conductive member are successively described below. The whole construction of an electronic apparatus in accordance with each of the embodiments is substantially common to the above embodiments.

[Embodiment 6]

Figure 24:
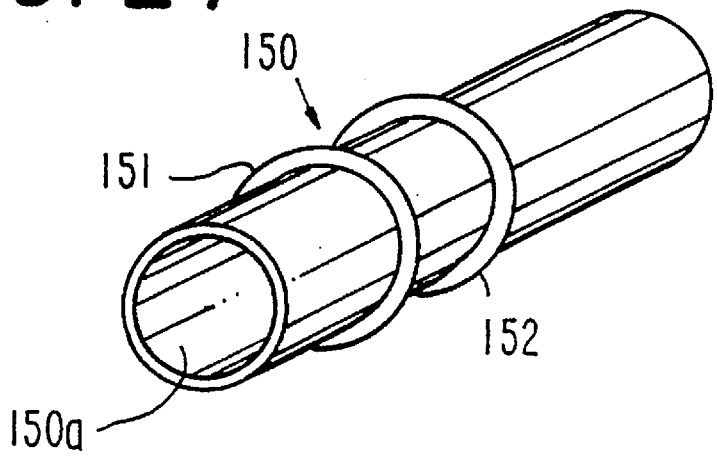
FIG. 24 is a perspective view illustrating the shape of an insulating surrounding member in accordance with Embodiment 6 of the present invention.
Figure 25:
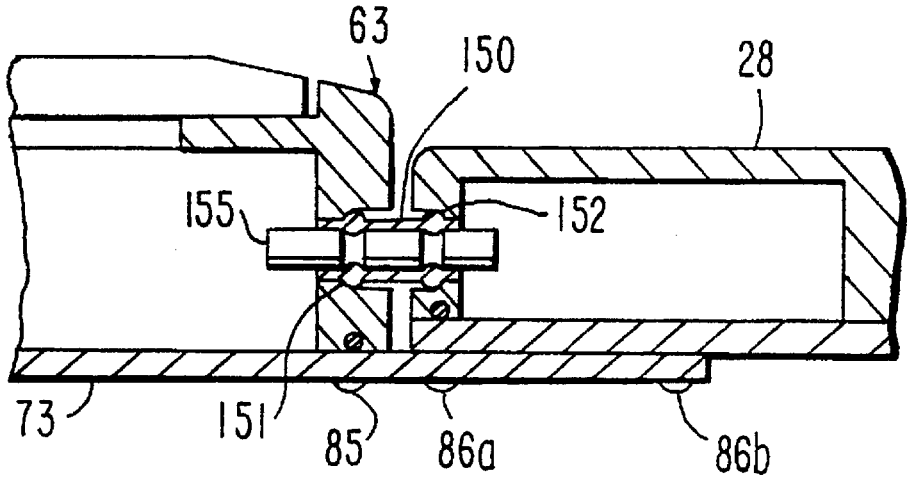
FIG. 25 is a longitudinal sectional view illustrating a conductive connection structure between the case and an end piece in the same embodiment.

FIGS. 24 and 25 are drawings illustrating Embodiment 6. The insulating surrounding member 150 shown in FIG. 24 is made of an insulating high-molecular material having elasticity, such as IIR (butyl rubber) or NBR (acrylonitrile butadiene rubber). The insulating surrounding member 150 is formed like a hollow shape having a through hole portion 150*a*. As shown in FIG. 25, the insulating surrounding member 150 is used in a state where it covers the periphery of a conductive terminal member 155. In this embodiment, the conductive terminal member 155 is preferably contained in a mold for forming the insulating surrounding member 150 by insert molding.

The insulating surrounding member 150 may be formed so that a single conductor is passed therethrough, as shown in the drawing, or so that a plurality of conductors are covered. In this case, it is preferable for maintaining insulating properties between respective conductors that a plurality of conductors are buried in an insulating resin which is contained in the insulating surrounding member 150.

FIG. 25 illustrates an embodiment in which the insulating surrounding member 150 and the conductive terminal member 155 are used for connecting a case band 63 of a wrist watch and an end piece 28. The case band 63 of the wrist watch is fixed to a case back 73 by screws 85, and the end piece 28 is fixed to the case back 73 by screws 86*a* and 86*b*. The facing sides of the case band 63 and end piece 28 which are adjacent to each other have respectively conducting holes formed at opposite positions so that the conductive terminal member 155 provided with the insulating surrounding member 150 is forced into each of the conducting holes. The insulating surrounding member 150 is provided with projecting seal portions 151 and 152 which are formed in a ring, as shown in FIG. 24. The projecting seal portions are respectively forced into the conducting holes of the case band 63 and the end piece 28 to create a seal between the insulating surrounding member 150 and both conducting holes.

The insulating surrounding member 150 functions as a waterproof packing and an insulating member between conductive members and between the conductive members and the watch case or the band. Since the position between the insulating coating and the packing is previously defined, assembly is easy, and production cost can thus be decreased. Since sweat or water does not adhere directly to the conductive terminal member 155, corrosion resistance need not taken into consideration, and the material for the conductive terminal member 155 can be selected on the basis of electrical characteristics alone. In addition, since there is no need to provide another sealing member over the insulating coating, the diameter of the terminal portion can be decreased, and therefore an attempt can be made to thin the case band 63.

When a battery is contained in the end piece 28, the conductive terminal members 155 are connected directly to the electrode or a connective fitting. When the conductive wires 30, the same as those used in each of the above embodiments, are disposed in the band, the conductive terminal member 155 may be connected to each of the conductive wires 30 by solder or the like in the end piece 28, or each of the conductive wires 30 may be passed through the insulating surrounding member 150 in place of the conductive terminal member 155.

Although the end piece 28 is fixed to the case band 63 through the case back 73, as shown in FIG. 25, the end piece 28 may be connected rotatably with respect to the case band 63 by using a spring bar, for example. In this case, the insulating surrounding member 150 must be made of a material with sufficient elasticity or flexibility so that it can follow the rotational displacement of the end piece 28. A bent portion comprising a hinge structure, for example, is preferably provided on the conductive terminal members and the conductive wires so as to follow the rotation of the end piece, and a slide structure is provided for absorbing a displacement in the direction of extension of the conductive member caused by the rotation of the end piece.

[Embodiment 7]

Figure 26:
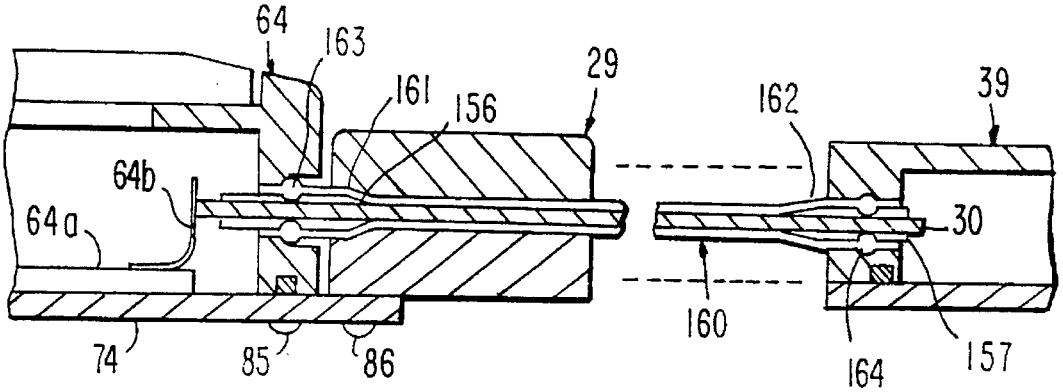
FIG. 26 is a longitudinal sectional view illustrating a conductive connection structure between the case and an end piece in accordance with Embodiment 7 of the present invention.

FIG. 26 illustrates a structure in accordance with Embodiment 7 of the present invention. A case band 64 of a wrist watch and an end piece 29 are connected and fastened to each other by screws 85 and 86 through a case back 74. Both ends of a conductive wire 30 are respectively inserted into conductive terminal members 156 and 157, and coated with enlarged-diameter portions 161 and 162 formed at both ends of an insulating surrounding member 160. The enlarged-diameter portions 161 and 162 have projecting seal portions 163 and 164, respectively, formed integrally thereon. The insulating surrounding member 160 is continuously formed so as to completely coat each of the conductive wires 30 between the enlarged-diameter portions 161 and 162. Both ends of each of the conductive wires 30, coated with the insulating surrounding members 160, are forced into conducting holes formed in the side of the case band 64 and conducting holes formed in a piece member 39 among the constituent piece members of the band base, which contains a battery, a sensor and so on. In the case band 64, the end of each of the conductive wires 30 which projects from the tip of the conductive terminal member 156 is brought into pressure contact with an elastic terminal piece **64*b* connected to the circuit substrate 64*a* provided in the case band 64**.

Figure 27:
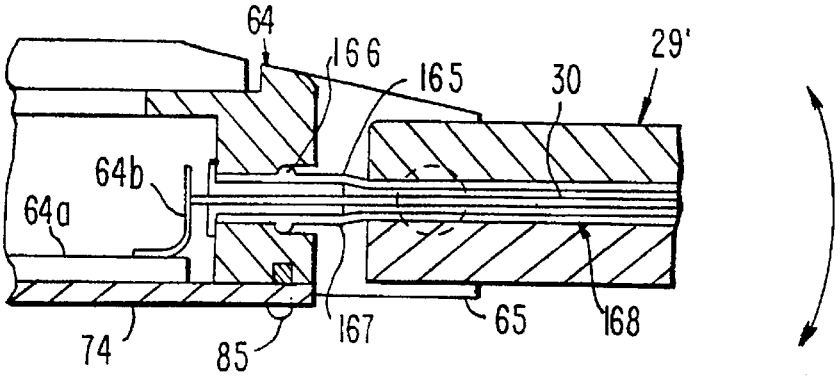
FIG. 27 is a longitudinal sectional view illustrating a modified embodiment of Embodiment 7.

FIG. 27 illustrates a modified embodiment of the above embodiment. In this modified embodiment, an insulating surrounding member 168 has an inner diameter greater than the outer diameter of the conductive wire 30 and has a gap between the conductive wire 30 and the insulating surrounding member 168. Each of the insulating surrounding members 168 has a projecting seal portion 166 formed at an end 165 thereof, which is inserted into a conducting hole formed in the side of the watch case band 64. The end 165 is held between the inner surface of the conducting hole and a cylindrical fitting member 167 which is forced into the hole from the inside of the case band 64, and secured to the case band 64. When the case band 64 is made of a conductor such as a metal, the fitting member 167 preferably comprises an insulator for preventing poor insulation. After the fitting members 167 are respectively forced into the holes, the conductive wires 30 are conductively connected to an elastic terminal piece **64*b* by brazing. In this embodiment, each of the insulating surrounding members 168 is made of a material having flexibility, and the end piece 29' is rotatably provided on the watch case band 64 by horns 65. When the end piece 29' is rotated, therefore, the insulating surrounding members 168 are deformed in accordance with the direction of movement. In this case, since a gap is present between the conductive wire 30 contained in each of the insulating surrounding members 168 and the insulating surrounding member 168 around the circumference of each of the wires 30, the stress caused by deformation of the insulating surrounding member 168 is decreased. The fitting member 167 securely fixes the end 165 of the insulating surrounding member 168, and supports the conductive wire 30 passed therethrough for a predetermined length for preventing bending thereof. In this portion, the lengthwise displacement caused by bending of the conductive wire 30 is absorbed by the elasticity of the elastic terminal piece 64*b*. In this case, for example, a hinge structure which permits bending of the conductive wire 30 is provided in the vicinity of the rotational axis of the end piece 29', or a slide structure is provided so as to be slidably overlapped on a portion of the conductive wire 30, thereby absorbing the lengthwise displacement of the conductive wire 30 and canceling stress to bend the conductive wire 30**.

Figure 28:
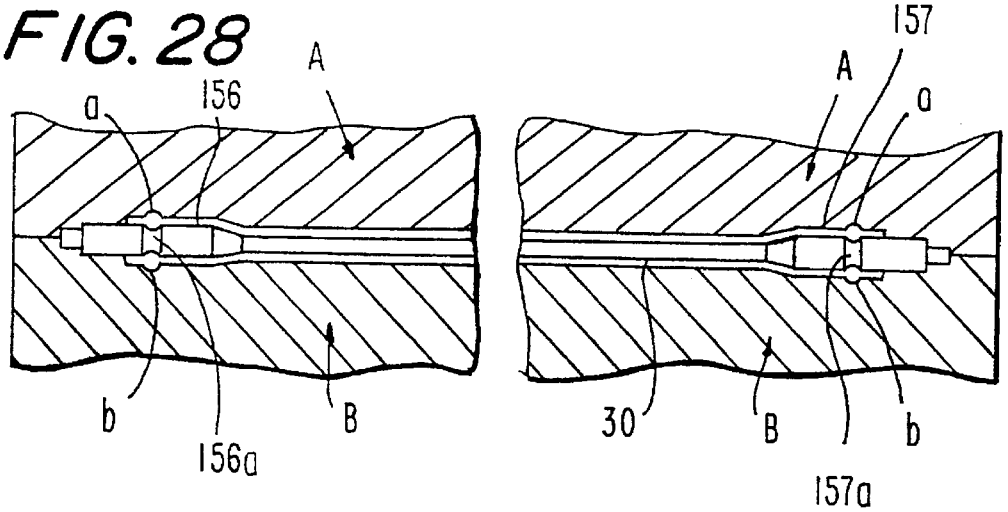
FIG. 28 is a longitudinal sectional view illustrating a mold structure for producing a conductive wire with an insulating coating in Embodiment 7.

Each of the wiring structures shown in FIGS. 26 and 27 is suitable for disposing in the band shown in each of Embodiments 1 to 4. Particularly, the insulating surrounding member 160 shown in FIG. 26 is preferably produced by insert molding, as shown in FIG. 28. The conductive wire 30 is previously fitted into the conductive terminal members 156 and 157, and then fixed by brazing, welding or caulking. Ring grooves **156*a* and 157*a* are formed on the surfaces of the conductive terminal members 156 and 157, respectively, and ring recessed portions a and b corresponding to the ring grooves 156*a* and 157*a*, respectively, are formed on the cavities of molds A and B. A synthetic resin material having elasticity which is the same as that used in Embodiment 6 is injected into the molds and then solidified to form the insulating surrounding member 160 shown in FIG. 26**.

In this embodiment, since the wiring and terminal portions are coated with the integral insulating surrounding member, the insulation work need not be carried out for the terminal portions (or the connecting portion) of the conductive wires 30 during assembly, and the production cost can thus be decreased. Since the projecting seal portion is integrally formed, sufficient waterproofness and insulating properties can be securely provided, and the diameter of the connecting portion can be decreased, thereby permitting an attempt to thin the case band 64.

The wiring structure shown in this embodiment has the same effects as those of Embodiment 6. For example, when this embodiment is applied to Embodiments 1 to 4, both ends of the wiring may be difficult to insert into the pipes 50 and 51 because both ends are enlarged in diameter. In this case, each of the pipes preferably comprises a roll-formed plate made of a shape-memory-alloy and having an opening, and is previously treated so that the opening opens in a high temperature phase, and closes in a low temperature phase. The wire may be inserted into the opening which is enlarged by heating, and then disposed in the band with the opening closed by cooling.

[Embodiment 8]

Figure 29:
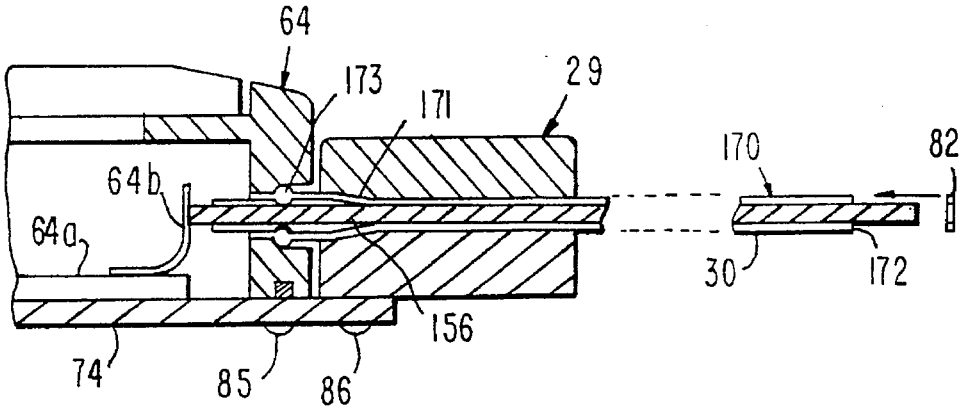
FIG. 29 is a longitudinal sectional view illustrating a conductive connection structure between the case and an end piece in accordance with Embodiment 8 of the present invention.
Figure 30:
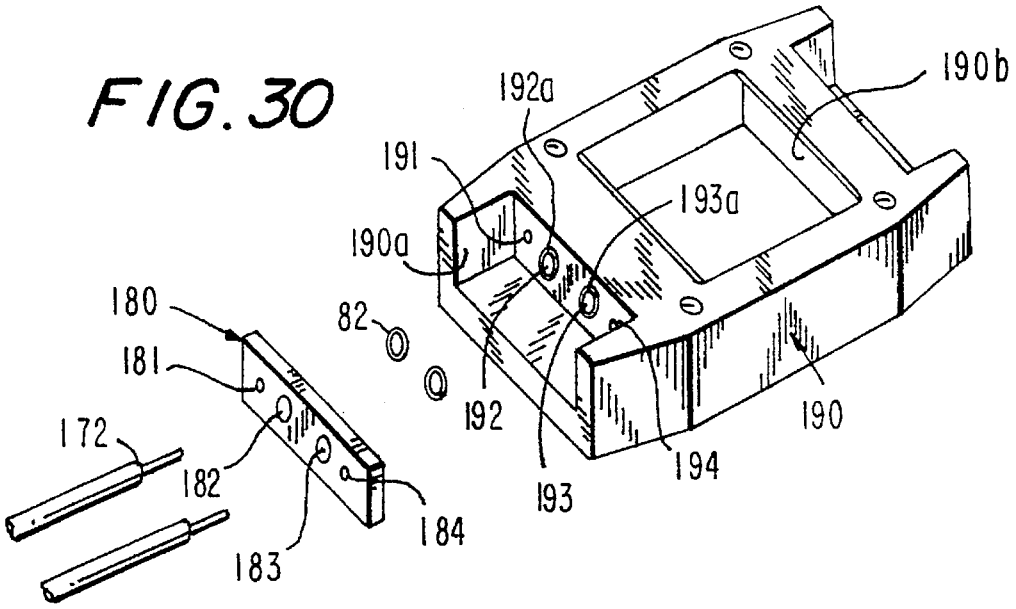
FIG. 30 is a perspective view illustrating a connection structure between the conductive wires and a housing member in Embodiment 8.

FIG. 29 illustrates Embodiment 8 of the present invention. In this embodiment, an insulating surrounding member 170 having the same end structure as that in Embodiment 7 is connected between the case band 64 and the end piece 29. In this embodiment, the same portions as those in Embodiment 7 are denoted by the same reference numerals, and are not described below. In this embodiment, the other ends 172 of the insulating surrounding member 170 are terminated in the state where they cover the peripheries of the conductive wires 30, as shown in FIG. 29. As illustrated in FIG. 30, the ends are respectively passed through through holes 182 and 183 of a mounting plate 180, through packings 82 as seal members and then inserted into the conducting holes 192 and 193 which are formed in a housing member 190 for a sensor or battery to be contained in the band.

Figure 31:
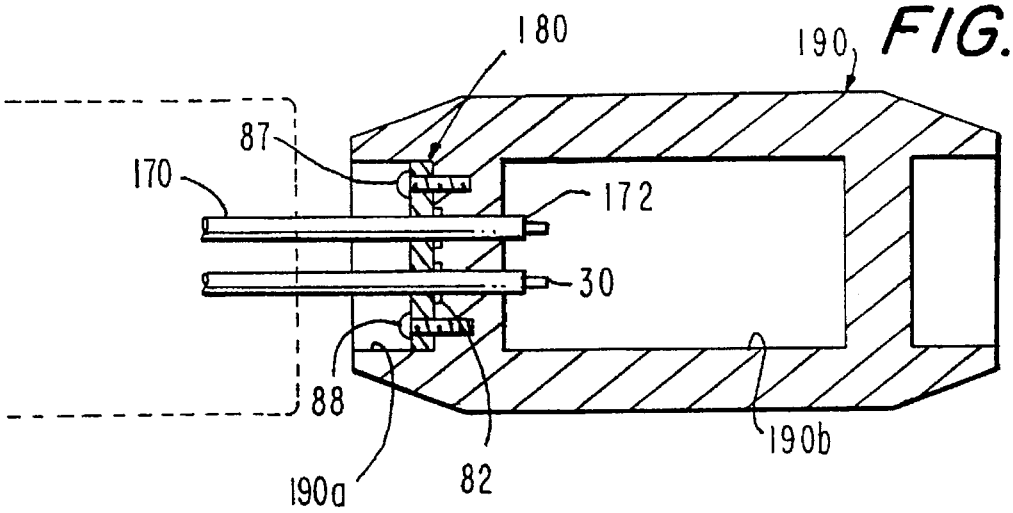
FIG. 31 is a sectional view illustrating the connection structure between the conductive wires and the housing member in Embodiment 8.

The mounting plate 180 has fixing holes 181 and 184 through which screws 87 and 88 are respectively screwed into threaded holes 191 and 192 of the housing member 190 so that the conductive wires 30 are fixed to the housing member 190, as shown in FIG. 31. The conducting holes 192 and 193 of the housing member 190 have the recessed portions **192*a* and 193*b*, respectively, formed at the opening verges thereof for receiving the packings 82. The packings 82 which are received in the recessed portions 192***a* and 193*a* are held under pressure in narrow portions between the mounting plate 180 and the housing member 190 so as to tightly hold the conductive wires 30 by the deformation caused by pressure.

The housing member 190 has a recessed portion 190*a* formed on the side where the conductive wires 30 are mounted so that the mounting plate 180 can be received therein, the recessed portion 190*a* communicating with a recessed housing portion 190*b* through the conducting holes 192 and 193. An electronic function part such as a sensor or battery is contained in the recessed housing portion 190*b*. A cover member (not shown) is mounted on the upper side of the housing member 190 so as to close the recessed housing portion 190*b*. The cover member is mounted by a known method such as screwing or caulking, and the mounting structure between the cover member and the housing member may be any desired structure such as a structure for holding packing under pressure, or a step-formed structure for engaging both members. The housing member 190 may be disposed in a piece member of the band, or the housing member 190 itself may form a piece member of the band or a fastener (buckle) of the band.

In this embodiment, since the diameter of the end 172 is not enlarged, the conductive wires 30 coated with the insulating surrounding members 170 can be inserted into the band after the band structure is completed, thereby facilitating production. The wiring connection to the electronic function part can also be securely performed. The conductive wires 30 are reliably fixed to the receiving member 190 by the mounting plate 180, thereby preventing application of a load to the connection points between the conductive wires 30 and the electronic function part.

A description will now be made of a plurality of embodiments in which a band base comprises a plurality of piece members rotatably connected to each other.

[Embodiment 9]

FIGS. 32 to 36 illustrate Embodiment 9 of the present invention which relates to a piece member. Embodiment 9 comprises an outer sheath member which forms an outer housing of a piece member, and an inner piece member which is rotatably contained in the outer sheath member and which has the function to connect adjacent outer sheath members. The outer sheath member and inner piece member may be made of any desired material, such as a metallic or non-metallic material, but both members generally comprise a metallic plate material.

FIGS. 32A–32G are perspective views illustrating various examples of construction of inner piece members. Each of inner piece members 210, 220 and 230 is formed by bending a plate material by press working. The inner piece members 210, 220 and 230 have openings 211, 221 and 222, and 231 and 232, respectively, which are formed so as to permit conductive members to pass between plate portions formed by bending a plate material. Of these various inner piece members, the inner piece member 230 having curved end surfaces is most preferred in view of its fit with the outer sheath member and rotational characteristics.

Inner piece members 240 and 250 comprise two plate parts 241 and 242, and 251 and 252, respectively, the plate parts having projection portions 241*a* and 242*a*, 251*a* and 251*b*, and 252*a* and 252*b*, respectively, which are projected in a hook-like form, and which respectively contact the surfaces of the opposite plate parts to secure the openings and spaces for passing the conductive members therethrough. In this way, since each of the inner piece members is divided into two plate parts, the design of each of the plate parts can easily be changed, for example, uneven portions 241*c*' and 241*c*" can be formed on plate parts 241" and 241", respectively.

Figure 33:
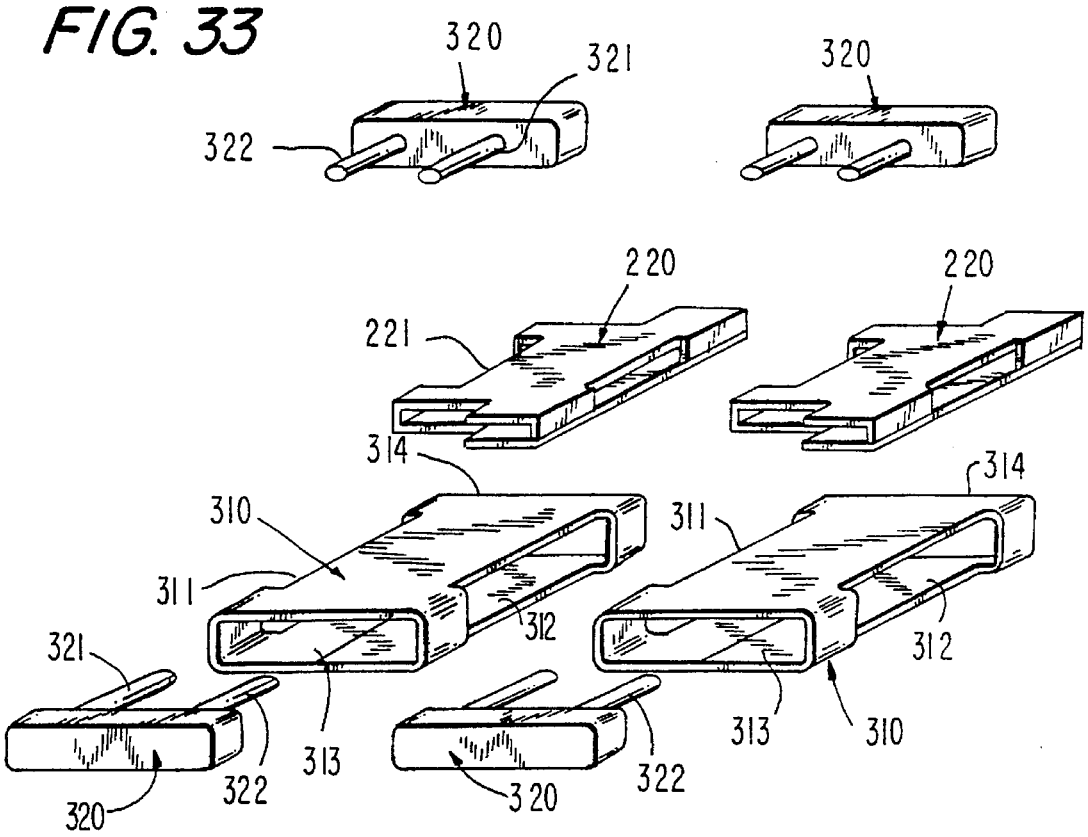
FIG. 33 is an exploded perspective view illustrating of the band structure of Embodiment 9.

FIG. 33 illustrates a base structure comprising a combination of the above inner piece member 220 and an outer sheath member 310 which can contains the inner piece member 220. The outer sheath member 310 is formed by bending a plate material in a square cylinder, and has openings 311 and 312 on the front and rear sides thereof, and open cover portions 313 and 314 on the right and left sides thereof. The inner piece member 220 is inserted into the outer sheath member 310 from the open cover portion 313 or 314 so that the rear end having the opening 221 is exposed to the outside through the opening 311. At this time, the inner piece member 220 cannot be removed from the opening 311 due to differences in the width.

Figure 34:
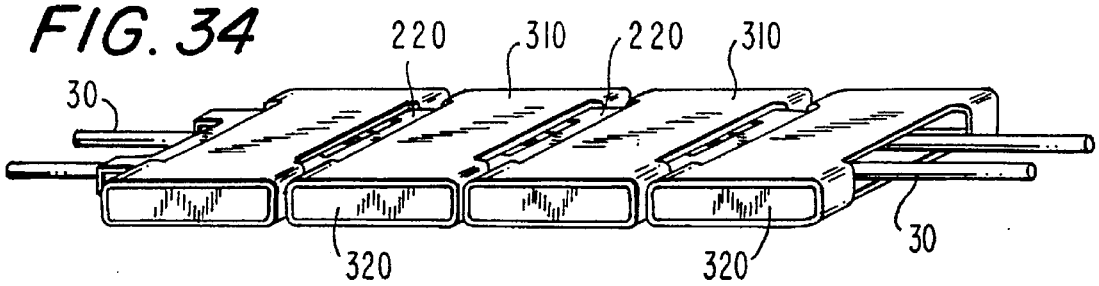
FIG. 34 is a perspective view of the assembly of Embodiment 9.

Similarly, another inner piece member 220 is inserted into an adjacent outer sheath member, and the rear end of the other inner piece member 220 which projects through the opening 311 is introduced into the outer sheath member 310 through the front opening 312. In this state, connecting members 320 are respectively inserted and forced into the right and left open cover portions 313 and 314 to insert, with play, projecting shafts 321 and 322 of the connecting members 320 between the upper and lower plate parts of the inner piece members 220. As a result, the outer sheath members 310 are connected to each other through the inner piece members 220, as shown in FIG. 34.

After the band is assembled as described above, the band is subjected to barrel polishing to form a mirror surface and washed, and then only the surfaces of the outer sheath members are subjected to, for example, a satin finish, to form a good design without a masking work in which the satin finish on the surfaces of the outer sheath members are clearly symmetrical with the mirror surfaces of the inner piece members in recessed portions.

This band structure is suitable for the present invention in the point that the conductive members can be inserted after assembly. When the band is placed in a line, as shown in FIG. 34, wiring can easily be performed by inserting the conductive wires 30 into the openings.

The angle of rotation between respective piece members can be set on the basis of the relation between the thickness of the inner piece members and the height of the housing inner space of each of the outer sheath members. Namely, the rotation of respective adjacent piece members when the band is bent is limited to an angle where the front and rear ends of an inner piece member contact the upper and lower surfaces of the inside of an outer sheath member. Thus a large local bending angle is not produced in the band, and the deformation fatigue of the conductive members passed through the band can be decreased. However, if the angle of rotation is decreased, since the fitting properties deteriorate, the ratio between the thickness of an inner piece member and the thickness of an outer sheath member is preferably appropriately set in consideration of balancing fitting properties, flexibility of the conductive members, and durability.

Figure 35:
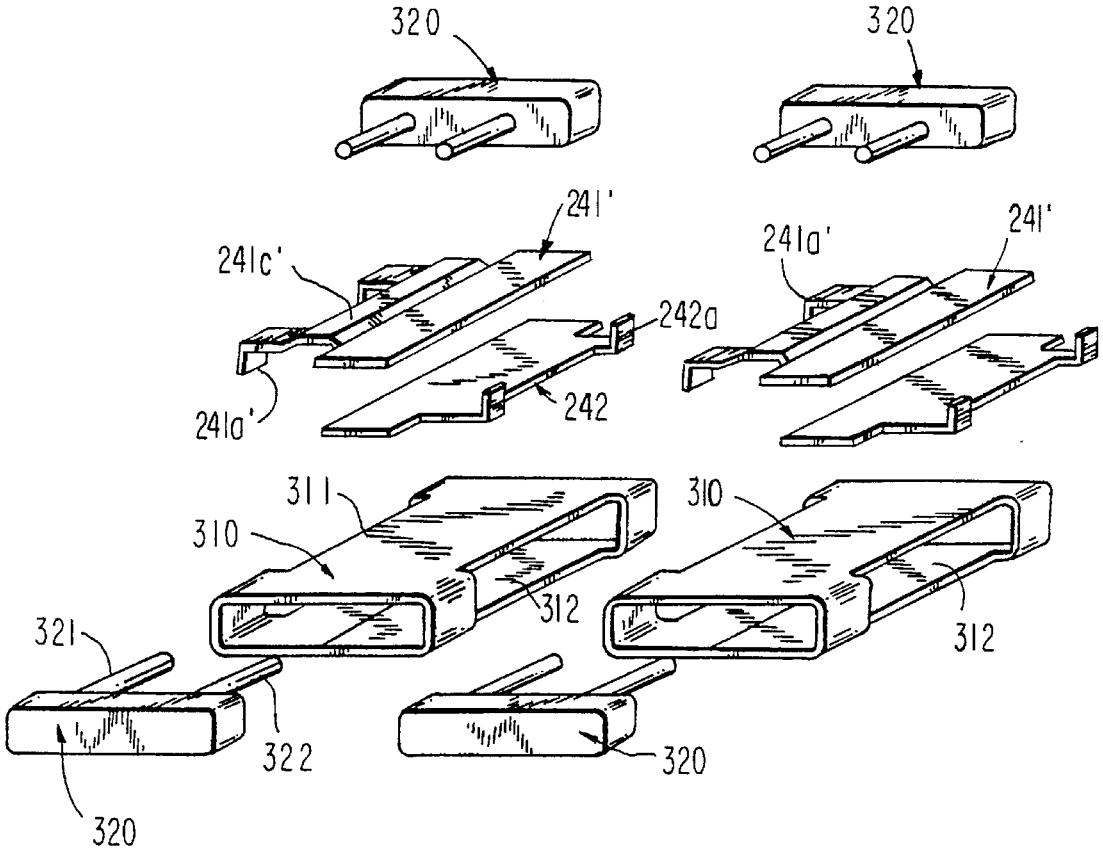
FIG. 35 is an exploded perspective view illustrating a different example of the band structure of Embodiment 9.
Figure 36:
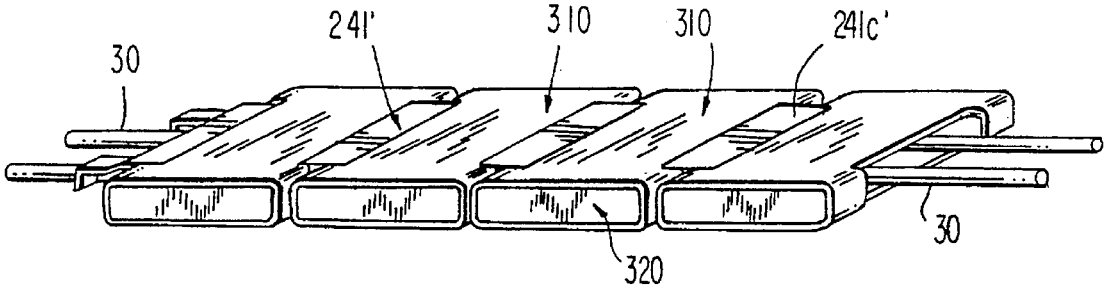
FIG. 36 is a perspective view illustrating the assembly of the same band.

FIG. 35 illustrates a band structure which uses an inner piece member which is similar to the inner piece member 240 shown in FIG. 32D, and the same outer sheath members 310 and connecting members 320 as those shown in FIG. 33. The assembly method is also the same as that shown in FIG. 33 except that two plate parts 241' and 242 are contained in each of the outer sheath members 310. In this embodiment, the appearance of the inner piece members which are respectively partly exposed from the outer sheath members 310 can be changed by the irregular portion 241*c*' formed on the plate parts 241'. For example, the recessed portions of the exposed inner piece members which are formed between the respective outer sheath members 310 shown in FIG. 34 can be made plane, as shown in FIG. 36.

The form of the border of each of the openings 311 and 312 of the outer sheath members 310 shown in FIGS. 33 and 35 is not limited to a straight line as shown in the drawings, and the opening border can easily be formed in various forms such as a wave-like form, an irregular form and so on. Thus, the appearance can be made varied, and the change in only the shape of the opening border is advantageous for suppressing an increase in cost.

FIG. 37 illustrates a band structure comprising a combination of the inner piece members 210 and the outer sheath members 330. Each of the outer sheath members 330 is provided with a rear opening 331, and a front opening 333 which is formed in the front side of a front receiving portion 332 forwardly projected. The inner piece members 210 are respectively inserted into the outer sheath members 330 from an open cover portion 334 or 335, and the border of the opening 211 is drawn out forwardly from the opening 333 of each of the outer sheath members 330. The border of the opening 211 is introduced into the opening 331 of the adjacent outer sheath member 330 and engages a projecting shaft 322 of each of the connecting members 320.

In the thus assembled band, as shown in FIG. 38, the front receiving portions 332 are respectively combined with the openings 331 of the adjacent outer sheath members 330 to connect the outer sheath members to each other. In this structure, since the inner piece members 210 are respectively interposed between the borders of the openings 333 and the conductive members 30 passed therethrough, the borders do not directly contact the conductive members 30. If each of the borders of the openings 333 has a sharp form, no problem occurs, and the openings 333 can be formed by cutting. On the other hand, since the front receiving portions 332 of the outer sheath members 330 are respectively inserted into the openings 331 of the adjacent outer sheath members 330, the inner piece members are hardly exposed between the respective outer sheath members 330, thereby permitting the arrangement of the appearance.

Figure 39:
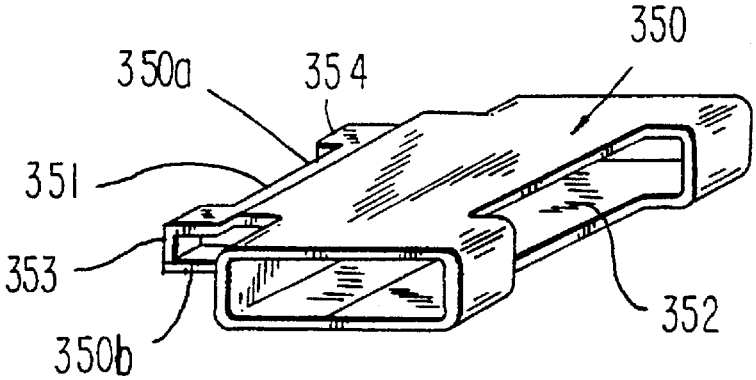
FIG. 39 is a perspective view illustrating the structure of a piece member comprising a single member, not comprising an internal piece member and an external sheath member.

In the piece member 350 shown in FIG. 39, the functions of the inner piece members 210 and the outer piece members 330 shown in FIGS. 37 and 38 are realized by a single member. The piece member 350 has tongue-like portions **350*a* and 350*b* which project rearwardly and between which an opening 351 is provided, a pair of projections 353 and 354 being formed on the left and right sides of the tongue-like portion 350*a*. The border of the opening 351 is introduced into an adjacent piece member 350 through a front opening 352 thereof, and engages the projecting shaft 322 of the connecting member 320 shown in FIGS. 37 and 38**. This structure permits easy assembly work using a single piece member, and an attempt to decrease the assembly cost.

Although this embodiment relates to the case where two conductive members are passed through the band, one conductive member or at least three conductive members may be passed through the band, and a conductive member comprising a laminated foil or a flexible sheet (substrate) in which a wiring pattern is formed on a resin base may be passed through the band.

[Embodiment 10]

Figure 40:
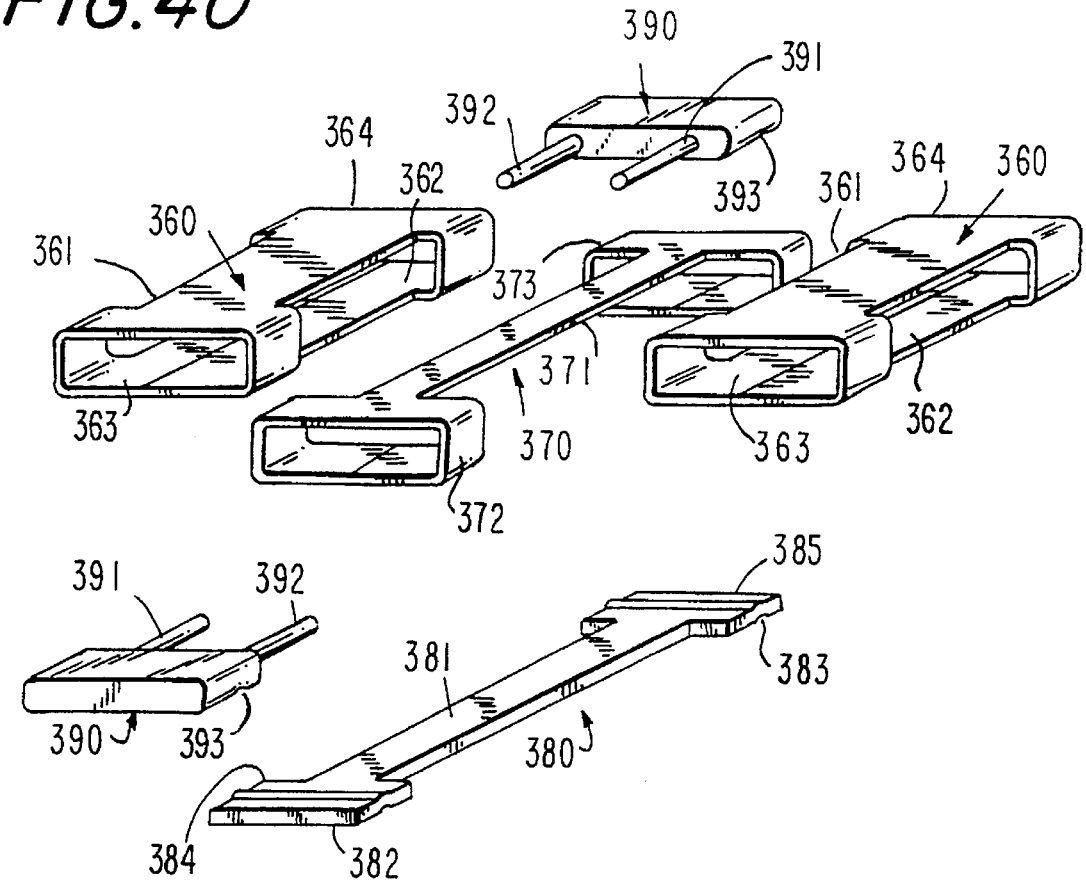
FIG. 40 is an exploded perspective view illustrating the band structure in accordance with Embodiment 10 of the present invention.

FIG. 40 illustrates Embodiment 10 of the present invention. The Embodiment 10 has a band structure in which respective piece members 360 are connected to each other through connecting members 370. Each of the piece members 360 has the form of a square cylinder which is substantially the same as that of the outer sheath members or the piece members of the above Embodiment 9, and is provided with front and rear openings 361 and 362 and open cover portions 363 and 364 on the left and right sides thereof. On the other hand, each of the connecting members 370 has, at the center thereof, a bridge-like portion 371 having a length which is substantially the same as the width of the piece members 360, and square cylinder-formed portions 372 and 373 at both ends of the bridge-like portion 371.

An engaging member 380 having a bridge-like portion 381 and engaging plates 382 and 383 provided at both ends thereof is inserted into the connecting members 370, and a pair of piece members 360 are inserted between the square cylinder-formed portions 372 and 373 of connecting member 370 from the front and rear sides thereof. Since the engaging plates 382 and 383 of the engaging member 380 have engaging ribs 384 and 385, respectively, which are provided on the surfaces thereof, when connecting members 390 are respectively forced into the square cylinder-formed portions 372 and 373 of the connecting members 370, engaging grooves 393 respectively formed on the bottom of the connecting members 390 engage the engaging ribs 384 and 385 of the engaging member 380. At the same time, projecting shafts 391 and 392 of the connecting member 390 engage each of the open cover portions 363 and 364 of the piece members 360 through the square cylinder-formed portions 372 and 373 of connecting member 370 to bring about a state where the piece members 360 and the connecting members 370 are alternately connected, as shown in FIG. 41.

This band structure is the same as that of the above Embodiment 9 in that it comprises two types of members including the piece members 360 and the connecting members 370. However, in this embodiment, since the exposed area of each of the piece members 360 corresponding to the inner piece members of Embodiment 9 can be increased, and the exposed area can, of course, be decreased, the limits on the band design can further be decreased, as compared with Embodiment 9.

Figure 41:
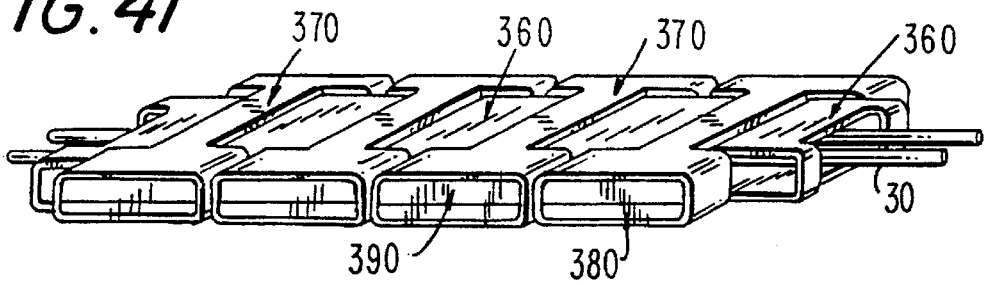
FIG. 41 is a perspective view illustrating the assembly of Embodiment 10.
Figure 42:
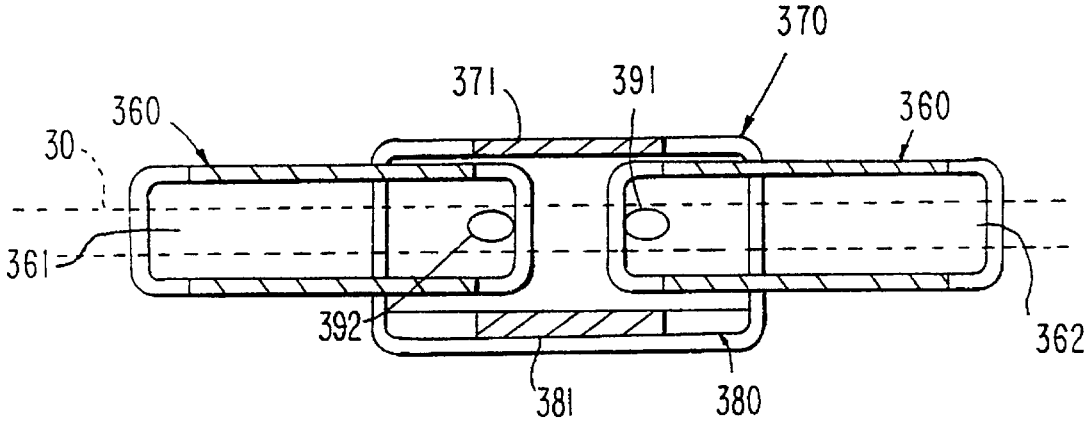
FIG. 42 is a sectional view illustrating the internal structure of a band of Embodiment 10.

In Embodiment 10, as shown in FIGS. 41 and 42, even if the distance between the piece members 360 is increased, the width of the bridge-like portions 371 can be adjusted so as not to expose the internal conductive wires, thereby facilitating design of the band. It is also apparent that the distance between the piece members 360 can easily be changed by changing the form of the connecting members 370.

Figure 43:
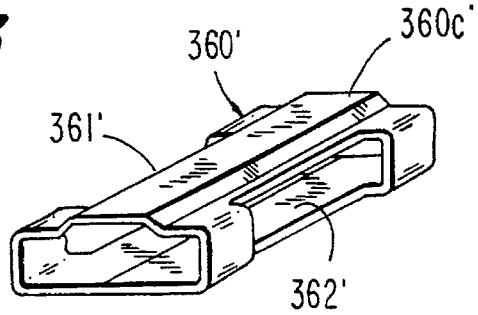
FIG. 43 is a perspective view illustrating a piece member which is the same as that of Embodiment 10 except an irregular portion is formed.

Although, in Embodiment 10, the connecting member 370 and the engaging member 380 are separately formed, both members can integrally be formed, for example, another bridge-like form may be provided on the lower side of each of the connecting members 370. Alternatively, the connecting members 390 may respectively engage directly the square cylinder-formed portions 372 and 373 of each of the connecting members 370 in place of the engagement structure comprising the connecting members 390 and the engaging members 380. Further, an irregular portion **360*c*' can be provided on an exposure surface, as in the piece member 360' shown in FIG. 43**, and the design of the border of each of the openings can be changed in a variety of ways.

[Embodiment 11]

Figure 44:
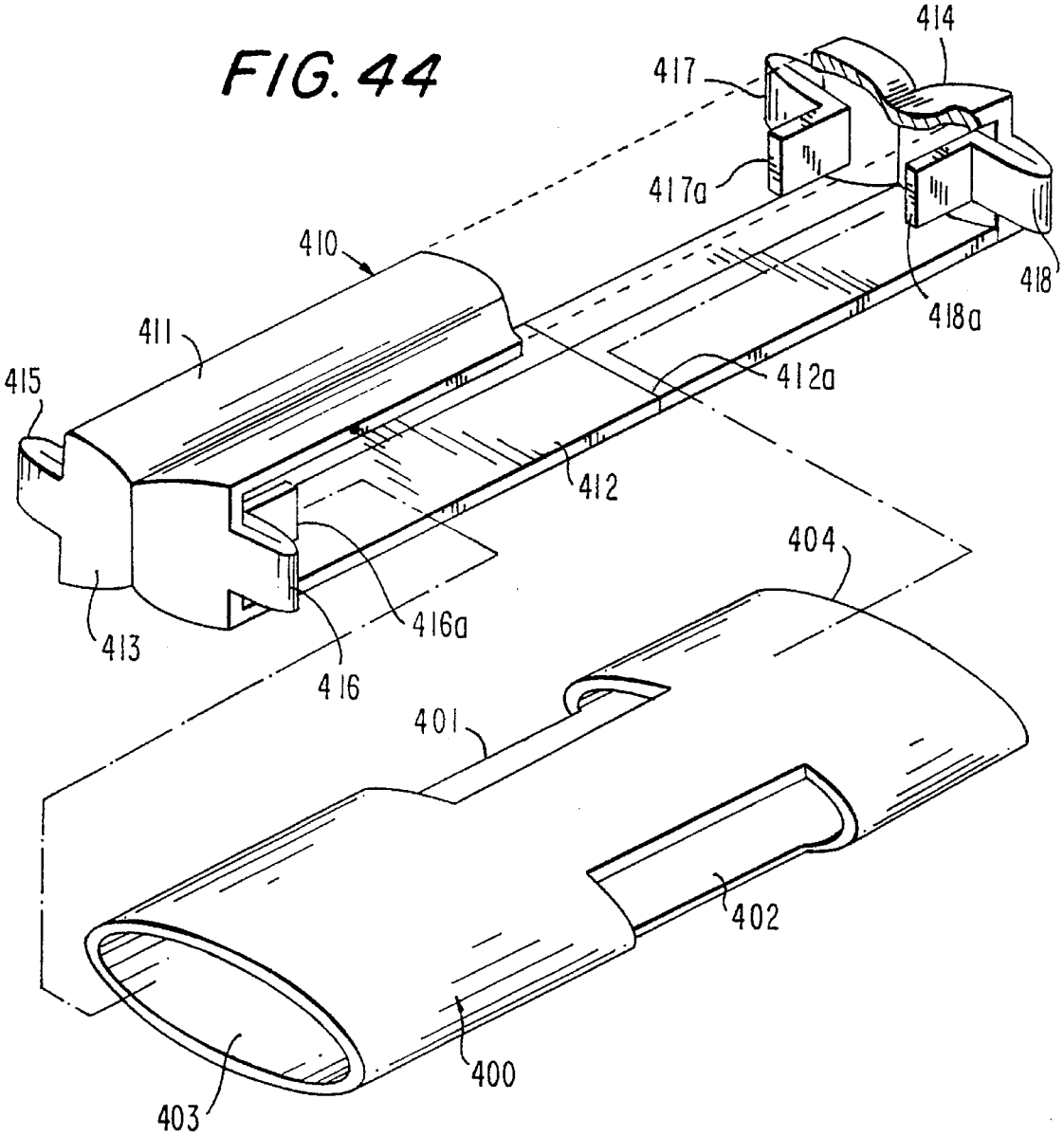
FIG. 44 is an exploded perspective view illustrating the structure of a band in accordance with Embodiment 11 of the present invention.
Figure 45:
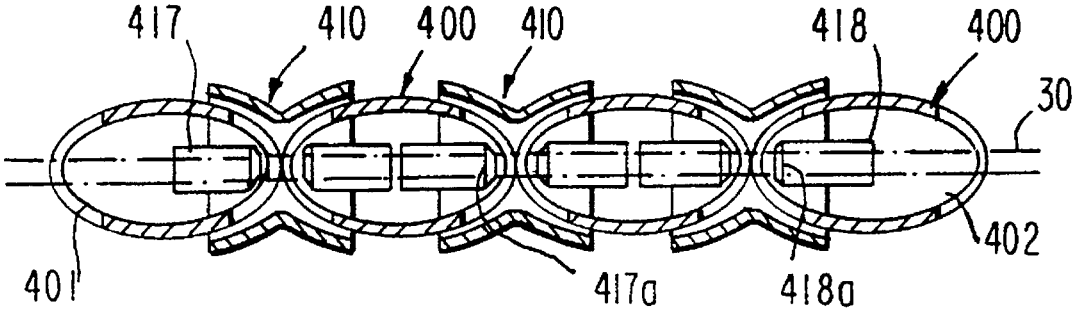
FIG. 45 is a sectional view illustrating the structure of a band of Embodiment 11.
Figure 46:
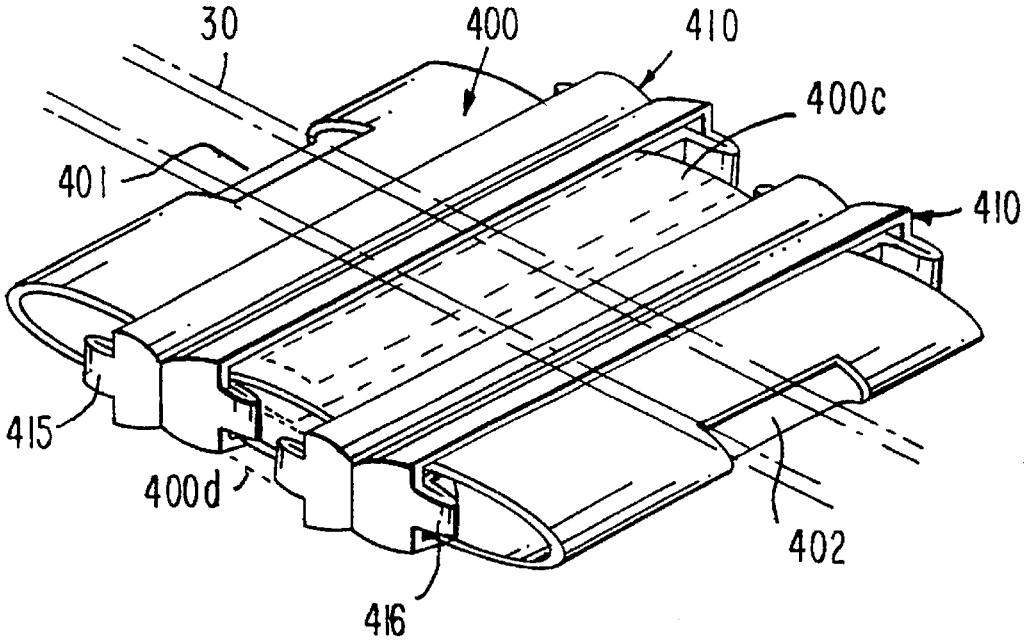
FIG. 46 is a schematic perspective view of Embodiment 11.

FIGS. 44 to 46 illustrate a structure in accordance with Embodiment 11 of the present invention. Embodiment 11 relates to a band structure in which elliptic cylinder-formed piece members 400 are connected to each other through connecting members 410. Each of the piece members 400 has front and rear openings 401 and 402 for passing conductive members therethrough, and open cover portions 403 and 404 on the left and right sides thereof. Each of the connecting members 410 has a rectangular frame form comprising an upper frame 411, a lower frame 412 and left and right sides 413 and 414, engaging arms 415 and 416, and 417 and 418 projecting from the sides 413 and 414, respectively. The engaging arms 415, 416, 417 and 418 are extended forward or rearward, folded toward the base side and further bent to form engaging ends 415*a* (not shown), 416*a*, 417*a* and 418*a*, respectively, which are inwardly extended toward the center from the sides 413 and 414.

In this band structure, each of the connecting members 410 is formed by folding a plate material in a rectangular form, as shown by the presence of a butt portion 412*a* of the lower frame 412 (FIG. 44). The piece members 400 and the connecting members 410 are combined by the method below, as shown in FIG. 45. After the engaging arms 415, 416, 417 and 418 are formed, the upper frame 411, the lower frame 412 and the sides 413 and 414 of each of the connecting members 410 are formed by folding. However, the piece members 400 are respectively brought into to contact with the connecting members 410 before folding, and the engaging ends 415*a* (not shown), 416*a*, 417*a* and 418*a* engage the open cover portions 403 and 404 of the piece members 400 during formation of the upper frame 411 and the sides 413 and 414 by folding. The sides 413 and 414 and the lower frame 412 are finally formed by folding to close the piece members by the butt portions 412*a*.

Since this embodiment, assembled as described above, is provided with the engaging arms, the band structure comprises only two types of parts including the piece members and the connecting members, and thus has the effect of decreasing the production cost. In addition, since each of the engaging arms has a bent form, the flexibility and elasticity can be adjusted by changing the bent form and the length, and it is possible to maintain proper rotational resistance to the band or to limit the angle of rotation between the respective piece members for protecting the conductive members passed through the band. Further, the distance between adjacent engaging arms can be adjusted so as to create contact force between adjacent piece members by the elasticity of the engaging arms, or prevent contact between adjacent piece members when the band is stretched.

In Embodiment 11, the design of each of the piece members and connecting members is highly flexible. For example, an irregular portion 400*c* can be provided on the upper side of each of the piece members 400, or a projecting edge 400*d* can be provided on the upper and lower portions of the open cover portion of each of the piece members 400, as shown by dotted lines in FIG. 46. This can be applied to the connecting members 410.

[Embodiment 12]

Figure 47:
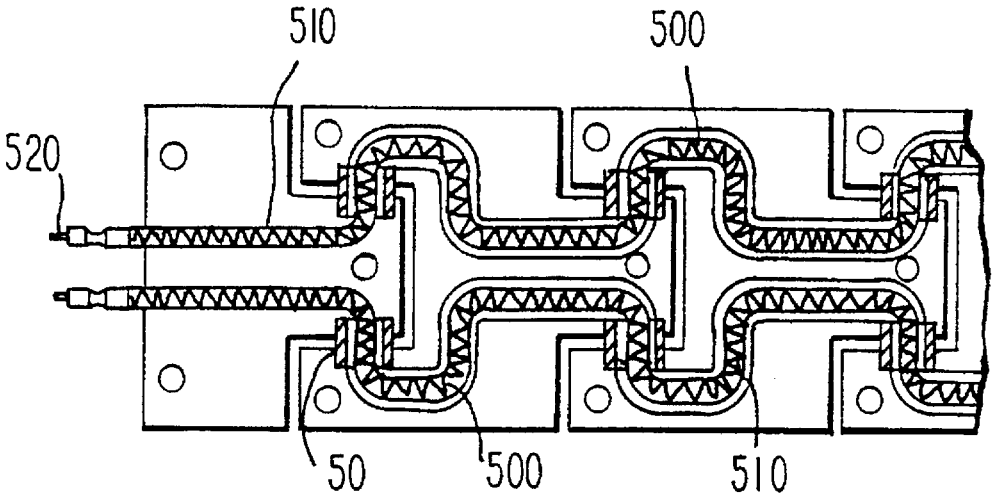
FIG. 47 is an exploded plan view illustrating the structure of a band in accordance with Embodiment 12 of the present invention.

Finally, Embodiment 12 comprises different conductive members is described with reference to FIGS. 47 and 48. Although a conductive wire with an insulating coating shown in each of the above embodiments is generally used as a conductive member, particularly, when the durability of the conductive member is taken into account, there is the danger that the conductive member is cracked or cut due to the repeated stress caused by deformation of the band. It is thus preferable to use conductive wires 500 which are helically or wavily bent, as shown in FIG. 47. Since each of the conductive wires 500 is provided with elasticity in the direction of extension due to the helical or wavy form thereof, the conductive wires 500 can easily expand and contract in the direction of extension thereof and bend at the time of deformation of the band, the resistance to the repeated deformation of the band can be increased.

Figure 48:
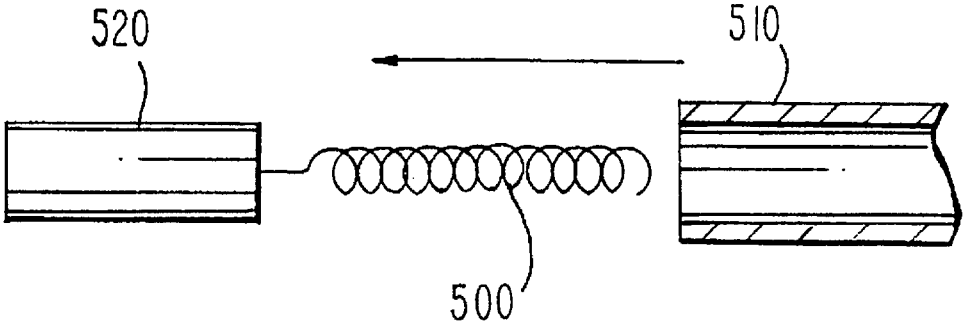
FIG. 48 is an enlarged view illustrating the structure of a conductive member of Embodiment 12.

Each of the conductive wires 500 is contained in an insulating tube 510 for maintaining the form of the wires so as to permit the wires to follow deformation of the band, and prevent wearing or deflection of the helical or wavy form from occurring due to unnecessary contact in deformation of the band, and is connected to a conductive terminal member 520 exposed from the end of the insulating tube, as shown in FIG. 48. Although the conductive wires 500 are generally helically or wavily bent over the whole length thereof, the wires may be partly bent in the form. Particularly, only a portion subjected to large deformation, e.g., portions passed through the pipes 50 shown in FIG. 47, may be helically bent. In this way, when only a portion of each of the conductive wires is bent, the production cost can be decreased, and the average diameter of a portion for containing the conductive wires 500 can be decreased, thereby thinning the band.

INDUSTRIAL APPLICABILITY

As described above, in the present invention, an electronic apparatus comprises a fitting band containing conductive members, an end piece engaged a case, and a base rotatably connected to the end piece. The fitting properties are thus improved because the base rotates by its own weight when set on an arm. In addition, since the conductive members are held by the end piece, but rotatably disposed with respect to the base, the stress applied to the connection portion between the case and the conductive members can be decreased even if the fitting band is deformed, and the stress applied to the internal conductive members and deformation thereof can also be decreased. It is thus possible to increase electrical durability, reliability and safety.

Since the end piece is fixed to the case, the conductive members are not subjected to deformation and load in the connection portion between the case and the fitting band, and thus durability of the conductive members can be ensured. Since the design of the portion mounted on the case can be freely applied to a "Roof-attached Horn style" structure, a "Tow Horn style" structure or a structure "without a horn", the limitations on design can be decreased.

The hollow members are arranged along the rotation axis, even if the base is rotated, the deformation of the conductive members respectively passed through the hollow members can be suppressed, and positions of the conductive members in the direction of extension of the fitting band can be maintained. It is thus possible to increase the durability, reliability and safety of the conductive members without applying a local load or a large deformation thereto.

Since each of the hollow members comprises a cylindrical connecting shaft so as to further have the function to position and support and rotatably connect the conductive members, the connecting structure is simplified, the number of necessary parts is decreased, and the assembly becomes easy.

The portions between the respective piece members which form the base exhibit the same functions and effects as those described above.

Since the auxiliary secondary battery is provided in the band, the storage capacity can be increased without limiting the housing capacity, and excess electric power which cannot be stored in the secondary battery in the watch case can be stored in the auxiliary secondary battery, thereby increasing the operating time with no power generation, and significantly decreasing the amount of electric power that is discarded for preventing overcharging, as compared with a conventional structure.

If the auxiliary secondary battery is intermitted by using a selective switching circuit, the synthetic capacity of the secondary battery and the auxiliary secondary battery can be adjusted by an operating member such as an operating button or the like or the control means, if required, and an accident such as a disconnection, short-circuit and so on on the side of the auxiliary secondary battery can thus be coped with.

The current limiting means can prevent a voltage drop on the side of the watch case during charging of the auxiliary secondary battery.

The insulating surrounding member can reliably ensure insulating properties in the portions where the conductive members are passed through, and thus prevent the poor insulation caused by adhesion of sweat or water.

Since the insulating surrounding members are fixed to the case with a gap between the insulating surrounding members and the conductive members and are provided with flexibility, the conductive members are slightly stressed even if the insulating surrounding members are deformed by rotation of the fitting band, and it is thus possible to prevent the occurrence of poor insulation and disconnection of the conductive members.

Since a projecting seal portion is integrally provided so that the insulating surrounding members ensure insulating properties and waterproofness in the portions where the conductive members are passed through, it is possible to prevent poor insulation or deterioration in durability caused by corrosion with a liquid, and to easily assemble the portions where the conductive wires are passed through.

A member's coating portion is integrally provided on the insulating surrounding members so as to further function as an insulating coating for each of the conductive members in the direction of extension thereof.

Since the ends of the conductive members can be securely connected to the electronic function member in the fitting band without enlarged diameter portions at the ends, such as insulating surrounding members, sealing portions or terminals, the conductive members can be passed after the fitting band is produced, thereby facilitating the assembly work.

Since a plurality of piece members which form the fitting band are connected to each other with an angle of rotation within a limited range, it is possible to prevent application of a large local deformation to the conductive members passed through the fitting band, and to attempt to prevent a disconnection accident and improve the durability. Specific structures of such a fitting band are described herein. These structures are assembled so as to be rotatable within a predetermined range of rotation without limiting the movement of the conductive members passed through the band. The design of the inner piece members can easily be changed. An attempt can be made to decrease production cost without increasing the number of parts. Since the connecting portion between the piece members can be covered by a bridge-like portion, the distance between adjacent piece members can be freely changed while preventing exposure of the conductive members. Since engaging arms are integrally provided on a connecting member, the need to prepare other engaging members for connection can be eliminated, and thus an attempt can be made to decrease the number of parts.

Since the conductive members are formed so that they can expand and contract in the direction of extension thereof, and an insulating coating is provided on each of the conductive members without interfering with expansion and contraction, it is possible to prevent damage to the conductive members, such as cracking or cutting, caused by deformation of the fitting band, and thus to improve the durability of the conductive members.

What is claimed is:

1. An electronic apparatus with a fitting band, comprising a case and a fitting band containing conductive members therein;

wherein said fitting band comprises an end piece engaging said case, and a base connected to said end piece so as to be rotatable in the direction of bending of said fitting band during fastening, and said conductive members are contained in a state where they are held to said end piece with at least a predetermined strength, and movable for at least a predetermined amount relative to said base, and at least a portion of said conductive members is provided so as to be substantially parallel to the direction of bending of said fitting band during fastening.

2. An electronic apparatus with a fitting band according to claim 1, wherein said end piece is fixed to said case.

3. An electronic apparatus with a fitting band according to claim 1, wherein hollow members are provided between said end piece and said base so as to be substantially parallel to the direction of bending of said fitting band during fastening, said conductive members being respectively passed through said hollow members.

4. An electronic apparatus with a fitting band according to claim 3, wherein each of said hollow members comprises a cylindrical connecting shaft which is mounted between said end piece and said base.

5. An electronic apparatus with a fitting band according to claim 3, wherein said base comprises a plurality of piece members which are connected to each other in the direction of extension of said fitting band so that adjacent piece members are connected so as to be rotatable in the direction of bending of said fitting band during fastening, and hollow members are disposed at least between piece members, in which said conductive members are disposed, so as to be substantially parallel to the direction of bending of said fitting band during fastening, said conductive members being respectively passed through said hollow members.

6. An electronic apparatus with a fitting band according to claim 1, wherein said case contains a generating device, a secondary battery for storing the electric power generated by said generating device, and an electronic device driven by the output from said secondary battery, and said fitting band contains an auxiliary secondary battery for storing excess electric power of the electric power generated by said generating device, which cannot be stored in said secondary battery.

7. An electronic apparatus with a fitting band according to claim 6, further comprising a selective switching circuit for selectively supplying electric power to said auxiliary secondary battery and taking out electric power therefrom.

8. An electronic apparatus with a fitting band according to claim 7, wherein said selective switching circuit is provided with control means for intermitting connection of said auxiliary secondary battery on the basis of the charging state of said secondary battery in order to adjust the charging rate of said secondary battery or prevent overcharging of said secondary battery.

9. An electronic apparatus with a fitting band according to claim 7, wherein said selective switching circuit is provided with control means for intermitting connection of said auxiliary secondary battery when detecting an abnormality of said auxiliary secondary battery.

10. An electronic apparatus with a fitting band according to claim 7, wherein said selective switching circuit is provided with current limiting means for limiting a charging current for said auxiliary secondary battery.

11. An electronic apparatus with a fitting band according to claim 1, wherein each of said conductive members is bent in the direction crossing the direction of extension thereof so that it can expand and contract in said direction of extension, an insulating coating being formed on the periphery of each of said conductive members without interfering with expansion and contraction thereof.

* * * * *